US007212773B2

(12) United States Patent
Sudo et al.

(10) Patent No.: US 7,212,773 B2
(45) Date of Patent: May 1, 2007

(54) IMAGE FORMING APPARATUS

(75) Inventors: Kazuhisa Sudo, Kanagawa (JP); Kazuyuki Sugihara, Kanagawa (JP); Hideo Yoshizawa, Saitama (JP); Katsumi Masuda, Tokyo (JP); Hideki Kimura, Kanagawa (JP); Kiyotaka Sakai, Kanagawa (JP); Tsuyoshi Imamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/943,950

(22) Filed: Sep. 20, 2004

(65) Prior Publication Data

US 2005/0111882 A1 May 26, 2005

(30) Foreign Application Priority Data

Sep. 19, 2003 (JP) ..... 2003-328263
Jul. 23, 2004 (JP) ..... 2004-215312

(51) Int. Cl.
*G03G 15/06* (2006.01)

(52) U.S. Cl. ..... 399/222; 399/119; 399/121; 399/167; 464/182

(58) Field of Classification Search ..... 399/222, 399/119, 121, 167; 464/182
See application file for complete search history.

(56) References Cited

U.S. PATENT DOCUMENTS 4,975,748 A 12/1990 Koinuma et al.
5,003,354 A 3/1991 Takamiya et al.
5,105,226 A 4/1992 Sugihara
5,244,741 A 9/1993 Nagano et al.
5,384,628 A 1/1995 Takami et al.
5,394,231 A 2/1995 Sudo et al.
5,552,877 A 9/1996 Ishikawa et al.
5,592,267 A 1/1997 Misago et al.
5,612,769 A 3/1997 Sugihara et al.
5,617,198 A 4/1997 Ishikawa et al.
5,638,158 A 6/1997 Sanpe et al.
5,646,721 A 7/1997 Sugihara et al.
5,657,115 A 8/1997 Sugihara (Continued)

OTHER PUBLICATIONS

U.S. Appl. No. 10/686,617, filed Oct. 17, 2003, Kamoi et al.

(Continued)

*Primary Examiner*—David M. Gray
*Assistant Examiner*—Joseph S. Wong
(74) *Attorney, Agent, or Firm*—Oblon, Spivak, McClelland, Maier & Neustadt, P.C.

(57) ABSTRACT

An image forming apparatus whereby it is possible to prevent unevenness in developing density caused by misalignment between the central axes of a driven side rotational coupling section for rotating a developer carrier and a drive side rotational coupling section for transmitting rotational drive force to the driven side rotational coupling section. The driven side rotational coupling section is fixed and the position thereof can be corrected slightly, by engaging the driven side rotational coupling section with a drive side rotational coupling section. A transmission gear is provided which meshes with the driven side rotational coupling section and transmits rotational drive force used to move the surface of the developer carrier. By means of an axle provided on at least one end of the transmission gear engaging with a positioning member on the main body of the image forming apparatus, the developer carrier is positioned in the main body of the image forming apparatus.

22 Claims, 15 Drawing Sheets

U.S. PATENT DOCUMENTS

| | | | | |
|---|---|---|---|---|
| 5,671,470 | A | 9/1997 | Maruta et al. | |
| 5,758,235 | A | 5/1998 | Kosuge et al. | |
| 5,761,576 | A | 6/1998 | Sugihara et al. | |
| 5,765,059 | A | 6/1998 | Kosuge et al. | |
| 5,765,079 | A | 6/1998 | Yoshiki et al. | |
| 5,768,662 | A | 6/1998 | Sugihara et al. | |
| 5,768,664 | A | 6/1998 | Kosuge et al. | |
| 5,787,328 | A | 7/1998 | Sugihara et al. | |
| 5,794,108 | A | 8/1998 | Yoshizawa et al. | |
| 5,826,146 | A | 10/1998 | Maruta et al. | |
| 5,850,586 | A | 12/1998 | Sugihara et al. | |
| 5,878,317 | A | 3/1999 | Masuda et al. | |
| 5,940,664 | A | 8/1999 | Sugihara et al. | |
| 5,946,529 | A | 8/1999 | Sato et al. | |
| 5,956,549 | A | 9/1999 | Sugihara et al. | |
| 5,970,290 | A | 10/1999 | Yoshiki et al. | |
| 5,970,294 | A | 10/1999 | Narita et al. | |
| 5,991,569 | A | 11/1999 | Sugihara et al. | |
| 6,070,037 | A | 5/2000 | Sugihara et al. | |
| 6,070,038 | A | 5/2000 | Imamura et al. | |
| 6,072,967 | A | 6/2000 | Sugihara et al. | |
| 6,104,900 | A | 8/2000 | Ishikawa et al. | |
| 6,112,042 | A | 8/2000 | Imamura et al. | |
| 6,122,469 | A | 9/2000 | Miura et al. | |
| 6,141,520 | A | 10/2000 | Kosuge | |
| 6,198,895 | B1 | 3/2001 | Tsuda et al. | |
| 6,226,481 | B1 | 5/2001 | Yoneda et al. | |
| 6,330,415 | B1 | 12/2001 | Imamura et al. | |
| 6,336,020 | B1 | 1/2002 | Ishikawa et al. | |
| 6,337,957 | B1 | 1/2002 | Tamaki et al. | |
| 6,393,241 | B1 | 5/2002 | Matsumoto et al. | |
| 6,501,913 | B2 | 12/2002 | Hattori et al. | |
| 6,522,855 | B1 | 2/2003 | Katoh et al. | |
| 6,553,202 | B2 | 4/2003 | Tamaki et al. | |
| 6,591,077 | B2 | 7/2003 | Yanagisawa et al. | |
| 6,615,014 | B2 | 9/2003 | Sugihara | |
| 6,628,908 | B2 | 9/2003 | Matsumoto et al. | |
| 6,665,508 | B2 | 12/2003 | Sudo et al. | |
| 6,697,593 | B2 | 2/2004 | Imamura et al. | |
| 6,751,433 | B2 | 6/2004 | Sugihara | |
| 6,763,214 | B2 | 7/2004 | Sugihara | |
| 6,768,890 | B2 * | 7/2004 | Cho et al. | 399/167 |
| 6,775,503 | B2 | 8/2004 | Hattori et al. | |
| 6,795,673 | B2 | 9/2004 | Yoshizawa | |
| 6,883,604 | B2 * | 4/2005 | Mack et al. | 166/105 |
| 2002/0172531 | A1 * | 11/2002 | Harada et al. | 399/167 |
| 2004/0101328 | A1 * | 5/2004 | Kimura et al. | 399/111 |
| 2005/0111882 | A1 | 5/2005 | Sudo et al. | |

OTHER PUBLICATIONS

U.S. Appl. No. 10/703,447, filed Nov. 10, 2003, Yoshiyuki et al.
U.S. Appl. No. 10/660,620, filed Sep. 12, 2003, Murakami et al.
U.S. Appl. No. 10/665,286, filed Sep. 22, 2003, Sakai et al.
U.S. Appl. No. 10/652,505, filed Sep. 2, 2003, Murakami et al.
U.S. Appl. No. 10/665,825, filed Sep. 22, 2003, Yoshizawa et al.
U.S. Appl. No. 10/798,382, filed Mar. 12, 2004, Ishibashi.
U.S. Appl. No. 10/746,060, filed Dec. 29, 2003, Enoki et al.
U.S. Appl. No. 10/440,108, filed May 19, 2003, Imamura et al.
U.S. Appl. No. 10/459,623, filed Jun. 12, 2003, Sugihara.
U.S. Appl. No. 10/329,356, filed Dec. 27, 2002, Muramatsu et al.
U.S. Appl. No. 10/757,439, filed Jan. 15, 2004, Sudo et al.
U.S. Appl. No. 10/678,091, filed oct. 6, 2003, Sudo et al.
U.S. Appl. No. 10/609,616, filed Jul. 1, 2003, Matsumoto et al.
U.S. Appl. No. 11/197,548, filed Aug. 5, 2005, Kasai et al.
U.S. Appl. No. 11/353,119, filed Feb. 14, 2006, Imamura.

* cited by examiner

IMAGE FORMING APPARATUS

BACKGROUND OF THE INVENTION

1. Field of the Invention

The present invention relates to an image forming apparatus, such as a copying machine, a facsimile machine, a printer, having a latent image carrier, such as a photosensitive drum, for carrying a latent image on the surface thereof, and a developing device for developing the latent image into a visible image, provided with a developing agent carrier, such as a developing roller, for carrying an image forming material on the surface thereof. More particularly, the present invention relates to a drive force transmission device used in an image forming apparatus of this kind for receiving the rotational drive force of a drive source side and transmit this force to the driven side.

2. Description of the Related Art

Generally, in an image forming apparatus, such as a copying machine, facsimile machine, printer, or the like, many rotating bodies, such as a drum-shaped photosensitive body, a developing roller, and the like, are used. In order to transmit rotational drive force to these rotating bodies, a method is known whereby a rotating axle of a rotating body (driven side) and a rotating axle of a drive source side are coupled by means of an axle joint, in such a manner that rotational drive force is transmitted from the rotating axle of the latter to the rotating axle of the former. However, misalignment of the central axes is liable to occur between the rotational coupling section on the driven side which causes the rotating body to rotate and the rotational coupling section on the drive source side which transmits rotational drive force to the rotational coupling section on the driven side, and hence there are problems to be resolved, such as fluctuation in the rotational speed of the rotating bodies caused by the aforementioned loss of central alignment.

Technologies relating the present invention are (also) disclosed in, e.g., Japanese Patent Laid-open No. 6-332285 and Japanese Patent Laid-open No. 2000-227690.

SUMMARY OF THE INVENTION

The present invention was devised with the foregoing problem in view, an object thereof being to provide a drive force transmission device and an image forming apparatus using same, which make it possible to prevent fluctuation in the rotational speed of rotating bodies caused by misalignment between the central axes of a driven side rotational coupling section for rotating a rotating body, such as a developer carrier, and a drive source side rotational coupling section for transmitting rotational drive force to the driven side rotational coupling section.

In accordance with the present invention, a drive force transmission device comprises a driven side rotational coupling section, coupled with a drive side rotational coupling section driven in rotation and receiving rotational drive force from same; and a transmission gear for transmitting rotational drive force by meshing with the driven side rotational coupling section. The position of the driven side rotational coupling section is corrected in a plane orthogonal to the axis of rotation, by engaging with the drive side rotational coupling section by approaching same in the direction of the axis of rotation thereof.

In accordance with the present invention, a developing device for an image forming apparatus comprises a developer carrier for conveying an image forming material carried on a moving surface to a position opposing a latent image carrier of the image forming apparatus, in accordance with movement of the surface, and creating a visual image of the latent image carried on the latent image carrier; and a drive force transmission device for receiving rotational drive force from a drive side rotational coupling section and transmitting same to the developer carrier, by means of a driven side rotational coupling section coupled with the drive side rotational coupling section provided inside the image forming apparatus and driven in rotation. The drive force transmission device comprises a driven side rotational coupling section, coupled with a drive side rotational coupling section driven in rotation and receiving rotational drive force from same; and a transmission gear for transmitting rotational drive force by meshing with said driven side rotational coupling section. The position of the driven side rotational coupling section is corrected in a plane orthogonal to the axis of rotation, by engaging with said drive side rotational coupling section by approaching same in the direction of the axis of rotation thereof.

In accordance with the present invention, there is provided a processing unit in which at least a latent image carrier for carrying a latent image and a developing device for developing a latent image on said latent carrier by means of an image forming material carried on the surface of a developer carrier are supported by a common supporting body. The processing unit is integrally detachable and attachable with respect to an image forming apparatus, as one unit. The developing device comprises a developer carrier for conveying an image format material carried on a moving surface to a position opposing a latent image carrier of the image forming apparatus, in accordance with movement of the surface, and creating a visual image of the latent image carried on the latent image carrier; and a drive force transmission device for receiving rotational drive force from a drive side rotational coupling section and transmitting same to said developer carrier, by means of a driven side rotational coupling section coupled with the drive side rotational coupling section provided inside the image forming apparatus and driven in rotation. The drive force transmission device comprises a driven side rotational coupling section, coupled with a drive side rotational coupling section driven in rotation and receiving rotational drive force from same; and a transmission gear for transmitting rotational drive force by meshing with the driven side rotational coupling section. The position of the driven side rotational coupling section is corrected in a plane orthogonal to the axis of rotation, by engaging with the drive side rotational coupling section by approaching same in the direction of the axis of rotation thereof.

In accordance with the present invention, a transfer device comprises a surface moving body having a moving surface, and a drive force transmission device for receiving rotational drive force from a drive side rotational coupling section disposed in an image forming apparatus and driven in rotation, and transmitting same to said surface moving body for transferring a visible image carried on a visible image carrier of the image forming apparatus onto the surface moving body or onto a recording body held on the surface of same. The drive force transmission device comprises a driven side rotational coupling section, coupled with a drive side rotational coupling section driven in rotation and receiving rotational drive force from same; and a transmission gear for transmitting rotational drive force by meshing with the driven side rotational coupling section. The position of the driven side rotational coupling section being corrected in a plane orthogonal to the axis of rotation, by engaging with the drive side rotational coupling section by approaching same in the direction of the axis of rotation thereof.

In accordance with the present invention, an image forming apparatus for forming images by means of a processing unit wherein at least a latent image carrier for carrying a latent image and a developing device for developing a latent image on said latent carrier by means of an image forming material carried on the surface of a developer carrier are supported by a common supporting body. The processing unit is integrally detachable and attachable with respect to an image forming apparatus, as one unit. The developing device comprises a developer carrier for conveying an image format material carried on a moving surface to a position opposing a latent image carrier of the image forming apparatus, in accordance with movement of the surface, and creating a visual image of the latent image carried on the latent image carrier; and a drive force transmission device for receiving rotational drive force from a drive side rotational coupling section and transmitting same to the developer carrier, by means of a driven side rotational coupling section coupled with the drive side rotational coupling section provided inside the image forming apparatus and driven in rotation. The drive force transmission device comprises a driven side rotational coupling section, coupled with a drive side rotational coupling section driven in rotation and receiving rotational drive force from same; and a transmission gear for transmitting rotational drive force by meshing with the driven side rotational coupling section. The position of the driven side rotational coupling section is corrected in a plane orthogonal to the axis of rotation, by engaging with the drive side rotational coupling section by approaching same in the direction of the axis of rotation thereof.

In accordance with the present invention, an image forming apparatus comprises visible image forming means for forming a visible image on the surface of a visible image carrier, and a transfer device for transferring a visible image on the visible image carrier onto a recording body, either directly or via an intermediate transfer body. The transfer device comprises a surface moving body having a moving surface, and a drive force transmission device for receiving rotational drive force from a drive side rotational coupling section disposed in an image forming apparatus and driven in rotation, and transmitting same to the surface moving body. The transfer device transfers a visible image carried on a visible image carrier of the image forming apparatus onto the surface moving body or onto a recording body held on the surface of same. The drive force transmission device comprises a driven side rotational coupling section, coupled with a drive side rotational coupling section driven in rotation and receiving rotational drive force from same; and a transmission gear for transmitting rotational drive force by meshing with the driven side rotational coupling section. The position of said driven side rotational coupling section is corrected in a plane orthogonal to the axis of rotation, by engaging with the drive side rotational coupling section by approaching same in the direction of the axis of rotation thereof.

In accordance with the present invention, an image forming apparatus comprises a latent image carrier for carrying a latent image on the surface thereof, a developing device for creating a visible image of the latent image, having a driven side rotational coupling section for receiving rotational drive force from an external source, and provided with a developer carrier for carrying an image forming material on the surface thereof; and a drive side rotational coupling section for transmitting rotational drive force to the driven side rotational coupling section. The driven side rotational coupling section is fixed and the position thereof is corrected by means of the driven side rotational coupling section engaging with the drive side rotational coupling section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Before describing the present invention, the prior art and the problems associated with same will be described.

Figure 1:
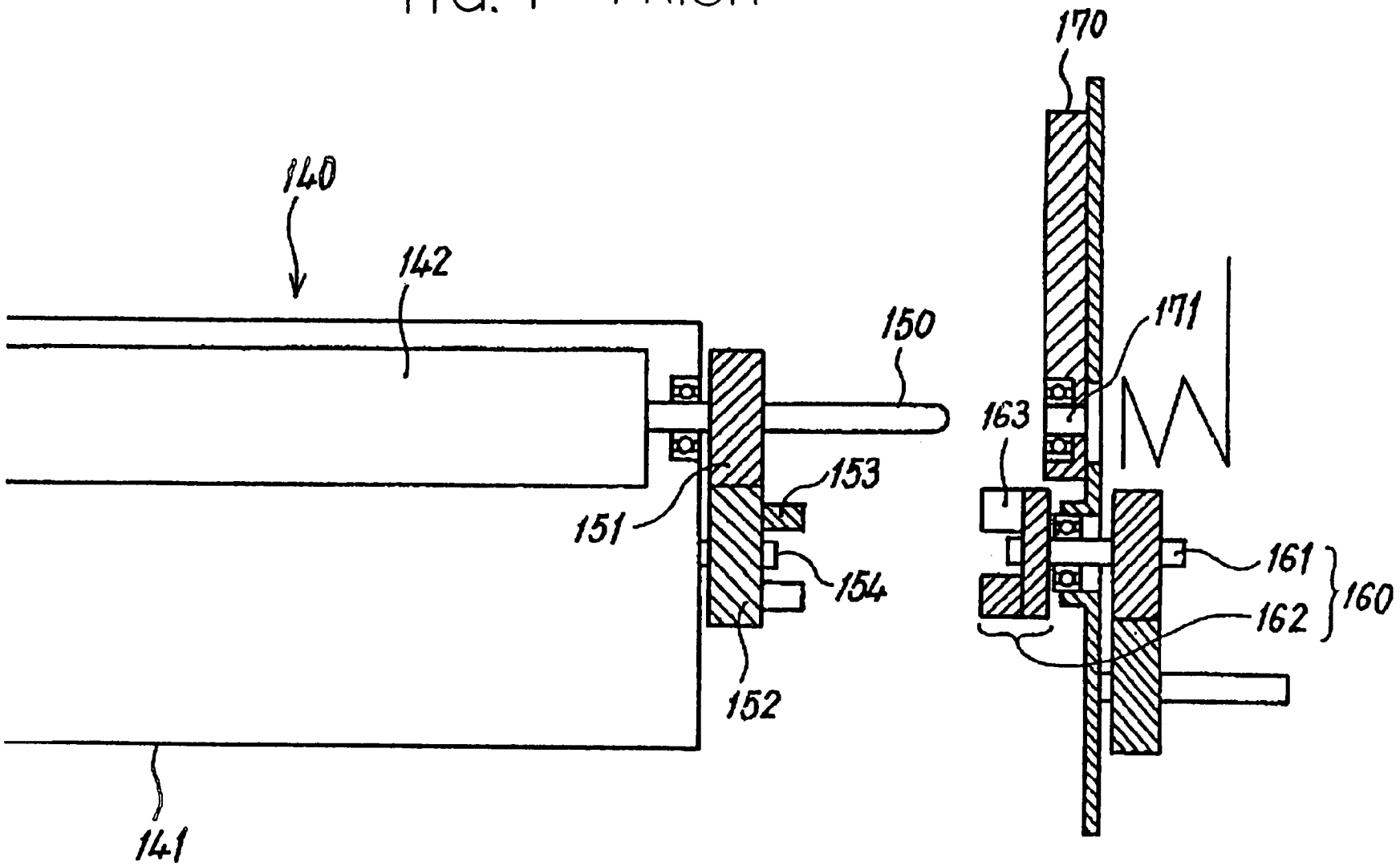
FIG. 1 PRIOR ART
FIGS. 1–3 are cross-sectional diagrams showing the composition of a drive coupling section in a conventional developing device.
Figure 2:
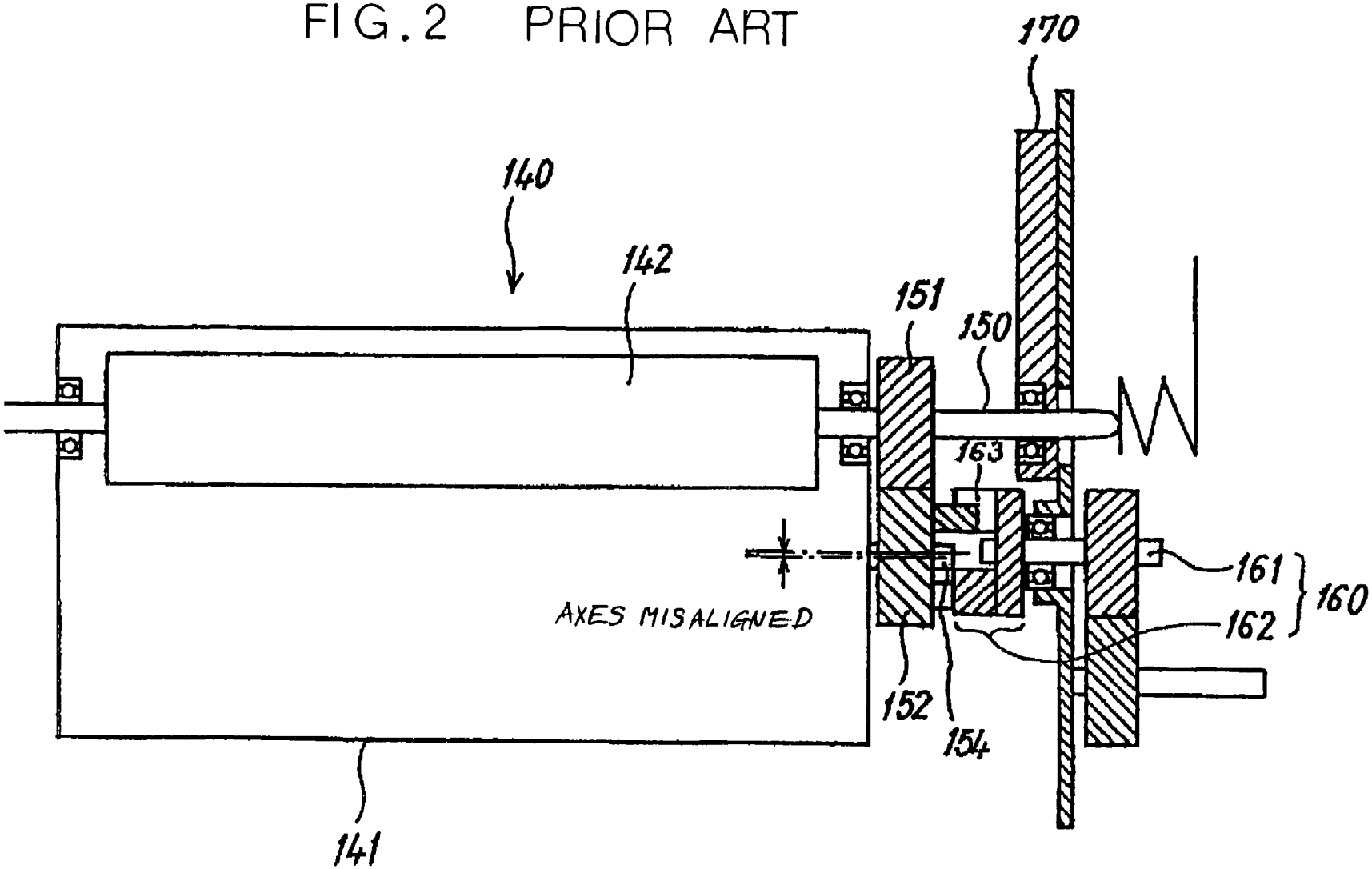
FIG. 2 PRIOR ART

FIG. 1 and FIG. 2 show the composition of a developing device of a conventional image forming apparatus. As shown in these diagrams, the developing device 140 is constituted by a developing roller 142 forming a developer carrier disposed in such a manner that it is partially exposed from the opening of the casing 141, and a conveyance screw and developer ductor, and the like, which are not illustrated. A developing roller axle 150 extends from the interior of the casing 141, via the side face of the casing 141 (the right-hand side in the diagram), and a roller gear 151 is fixed to the developing roller axle 150 on the outer side of the casing 141. A coupling gear 152 supported rotatably on the side face of the casing 141 meshes with the roller gear 151. Two fingers 153 forming a projecting section are provided in a protruding manner on the end face of the coupling gear 152. On the other hand, a drive output axle 160 receiving drive force from a drive motor (not illustrated) is provided on the main body side of the image forming apparatus. The drive output axle 160 forming a drive axle comprises an axle 161 and a coupling section 162 fixed to this end section. The coupling section 162 has two fingers 163 corresponding respectively to the two fingers 153 of the engaging gear 152, on the end face thereof.

When the disk control section 140 is installed in a printer, the coupling gear 152 on the disk control section 140 and the coupling section 162 on the drive output axle 160 of the printer main body project towards each other, as illustrated in FIG. 2. The coupling section 162 on the drive output axle 160 and the coupling gear 152 are coupled together. An axle joint is constituted by the end structure of the coupling gear 152 and the coupling section 162 forming the end structure of the drive output axle 160. By means of this axle joint, the rotational drive force of the drive output axle 160 is connected to the coupling gear 152. The rotational drive force is transmitted to the roller gear 151 which meshes with the coupling gear 152, thereby causing the developing roller 142 to rotate.

Besides this, an Oldham coupling has been used as an axle joint for coupling the two rotating bodies, and this coupling is disclosed in Japanese Patent Laid-open No. 6-332285 and Japanese Patent Laid-open No. 2000-227690 described above, and the like. However, since the Oldham coupling causes two coupling members and a slider member to rub against one another as the members rotate, it is not suitable for transmitting rotational drive force in a smooth manner.

Problems of the following kind arise in an image forming apparatus comprising a conventional drive transmission section as described above.

Figure 3:
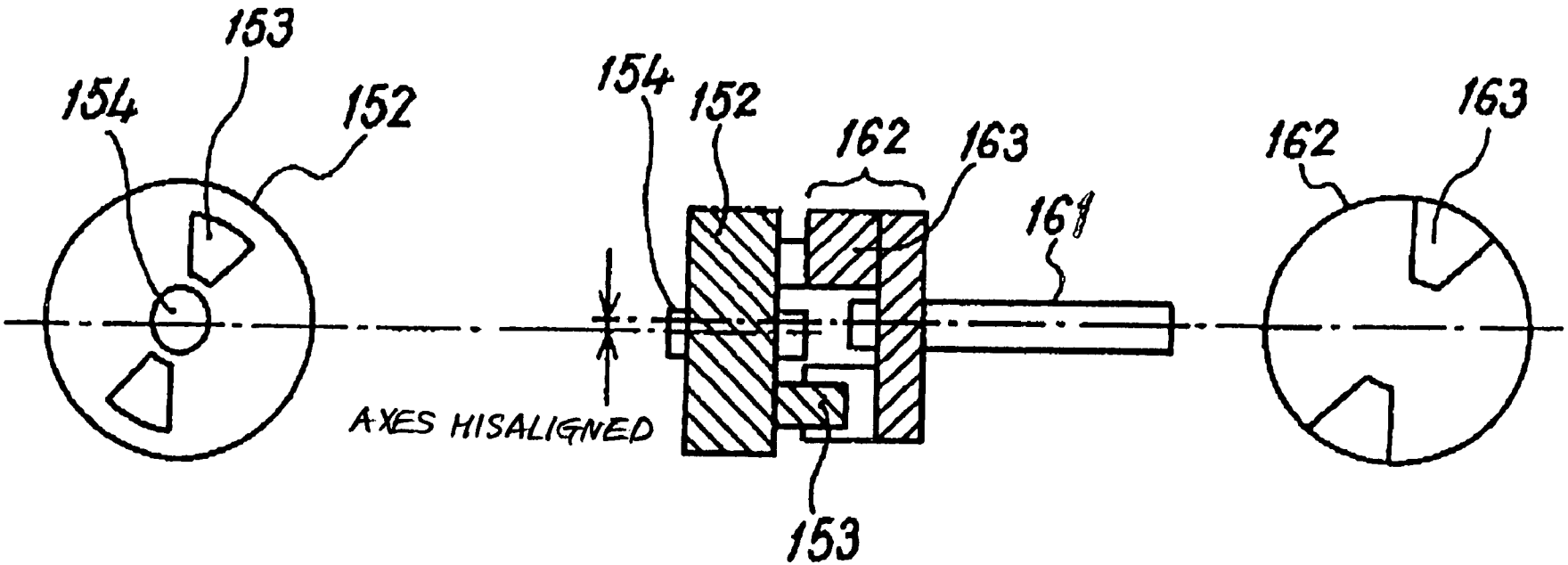
FIG. 3 PRIOR ART

In other words, misalignment between the central axes of the drive output axle 160 and the axle 154 fixed to the coupling gear 152 occurs, as illustrated in FIGS. 2 and 3. This is because the developing roller axle 150 provided on one end of the developing roller is inserted into the same side plate of the main body of the image forming apparatus as the side plate through which the drive output axle 160 is inserted. The reason for inserting the developing roller axle 150 into the main body of the image forming apparatus is that the developing roller must be positioned with respect to the main body of the image forming apparatus. Moreover, a further problem arises in that the aforementioned misalignment of the central axes may also occur as a result of vibrations in the developing device.

This axial misalignment causes slight fluctuation in the rotational speed of the developing roller 142, and for the following reasons, this gives rise to uneven developing density in the image.

More specifically, in the developing stage, the toner of a two-component developer provided on the developing roller 142 is removed from a magnetic carrier and transferred onto the electrostatic latent image on the photosensitive body which forms the image carrier. In this, it is desirable that the developing roller 142 rotates at a uniform speed, whilst maintaining a uniform gap between the developing roller 142 and the photosensitive body. However, if the rotational speed of the developing roller 142 fluctuates slightly due to the aforementioned axial misalignment, then the amount of toner conveyed to the developing position, namely, the position where the photosensitive body opposes the developing roller 142, per unit time, will vary, thereby giving rise to uneven developing density.

In particular, if an image having a relatively large surface area ratio, such as a photograph, is printed, then the unevenness in developing density will be more pronounced than in the case of an image of relatively small surface area ratio, such as text. In a monochrome image having high surface area ratio, a uniform unevenness in the developing density will cause a striped pattern in the direction of paper conveyance, thus impairing the appearance of the image. Moreover, in a full colour image having a large surface area ratio, unevenness in the developing density for each colour will appear as a shift in the colour tone. In the general marketplace, businesses such as design companies, for example, have to handle large images of this kind, and the occurrence of stripe-shaped unevenness in the developing density diminishes the product value markedly.

In recent years, there have been increasing demand for improved image quality, in addition to demands for increased durability of apparatuses. In order to improve image quality, there has been a tendency for the gap between the developing roller 42 and the photosensitive body to become narrower. However, as this gap becomes narrower, the unevenness in developing density caused by rotational speed fluctuations becomes ever more noticeable, and hence the problem of axial misalignment cannot be ignored. Moreover, with moves towards more compact apparatuses in recent years, there has also been a tendency for the coupling members themselves to become smaller in size. As the coupling members decrease in size, so the ratio of the central misalignment with respect to the diameter of the coupling becomes larger.

Furthermore, uneven developing density may also arise as a result of axial misalignment caused by slight vibrations occurring when the gear teeth make contact, but this has been improved significantly by changing from flat-tooth gears to oblique-tooth gears.

As described above, if there is misalignment between the central axes of the drive output axle 160 and the axle 154 fixed to the coupling gear 152, then the rotational speed of the rotating body, such as the developing roller 42, will vary. Therefore, if the rotating body is a developing roller 42, then unevenness will occur in the developing density, due to the variation in the rotational speed of the developing roller 42. Even in the case of a rotating body other than the developing roller 42, variation in the rotational speed is liable to cause a problem of same kind. For example, if the rotating body is a drive roller about which an intermediate transfer belt moves in an endless fashion, then central misalignment between the rotational coupling section on the drive source side, for instance, the drive output axle, and the rotational coupling section on the driven side, for instance, the coupling gear, will give rise to variation in the rotational speed of the drive roller. In turn, this will cause the speed of the intermediate transfer belt to vary, and hence uneven density will occur in the transfer image transferred from the image carrier, such as the photosensitive body, onto the intermediate transfer belt.

Below, a first embodiment wherein the present invention is applied to a tandem-type electrophotographic colour laser printer (simply called "printer" hereinafter), which is a image forming apparatus, will be described.

(Overall Composition)

Figure 9:
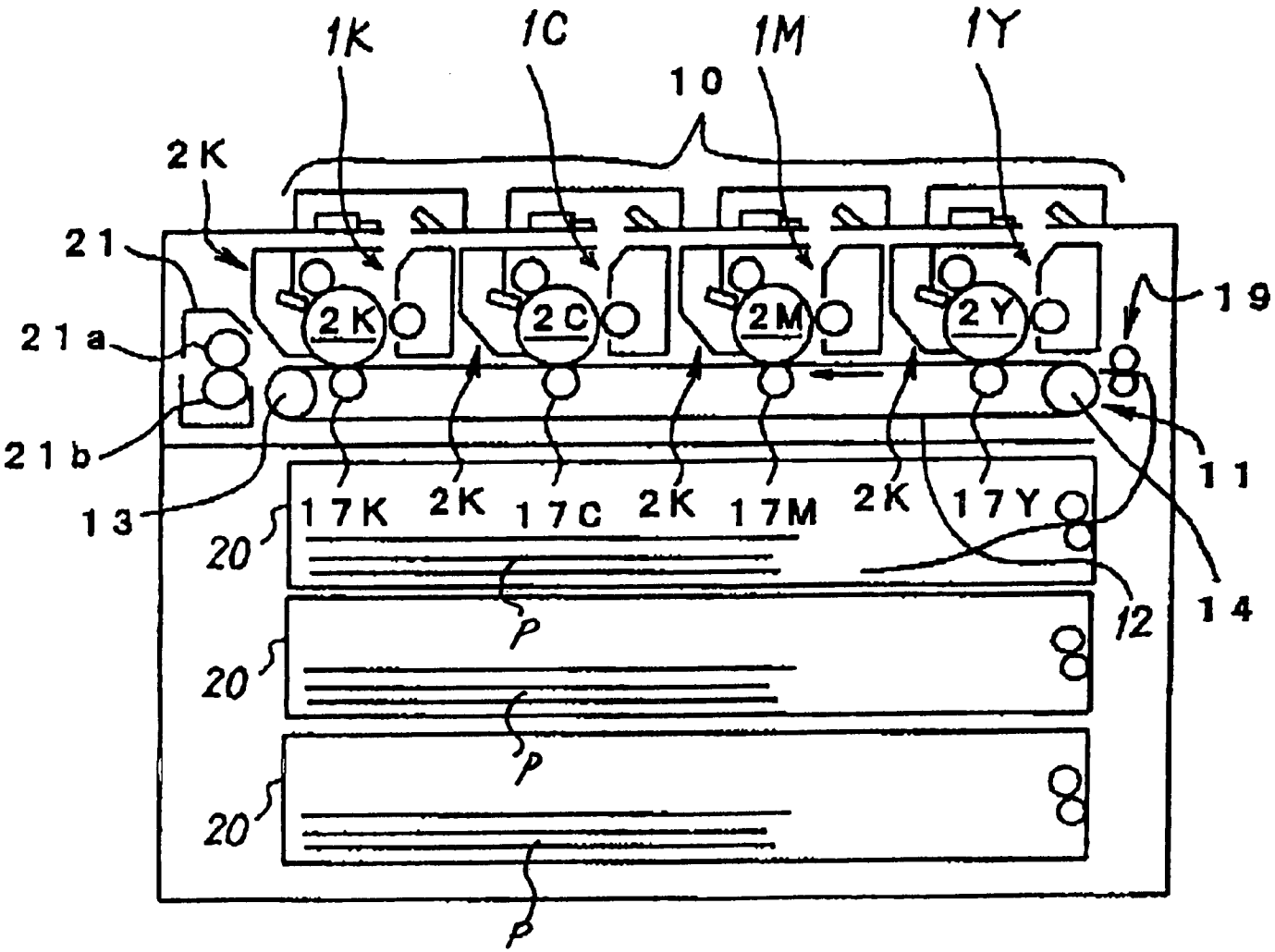
FIG. 9 is a diagram showing the general composition of a laser printer relating to the first embodiment.

FIG. 9 shows the general composition of a laser printer relating to this first embodiment. The laser printer comprises four processing units (1Y, 1M, 1C, 1K) for forming images of respective colours, namely, yellow (Y), magenta (M), cyan (C) and black (K). Naturally, the suffixes Y, M, C and K appended after the respective reference numbers indicate members used for yellow, magenta, cyan and black, respectively. This also applies similarly below. In addition to the processing units 1Y, 1M, 1C and 1K, the printer also comprises an optical writing unit 10, a transfer unit 11, a pair of resist rollers 19, three paper supply cassettes 20, a fixing unit 21, and the like.

(Optical Writing Unit)

The optical writing unit 10 comprises four optical writing elements. Each of these optical writing elements comprises a light source, a polygonal mirror, an f-θ lens, a reflecting mirror, and the like, and irradiates laser light onto the surface of the photosensitive body (described hereinafter), on the basis of image data.

(Processing Units)

Figure 10:
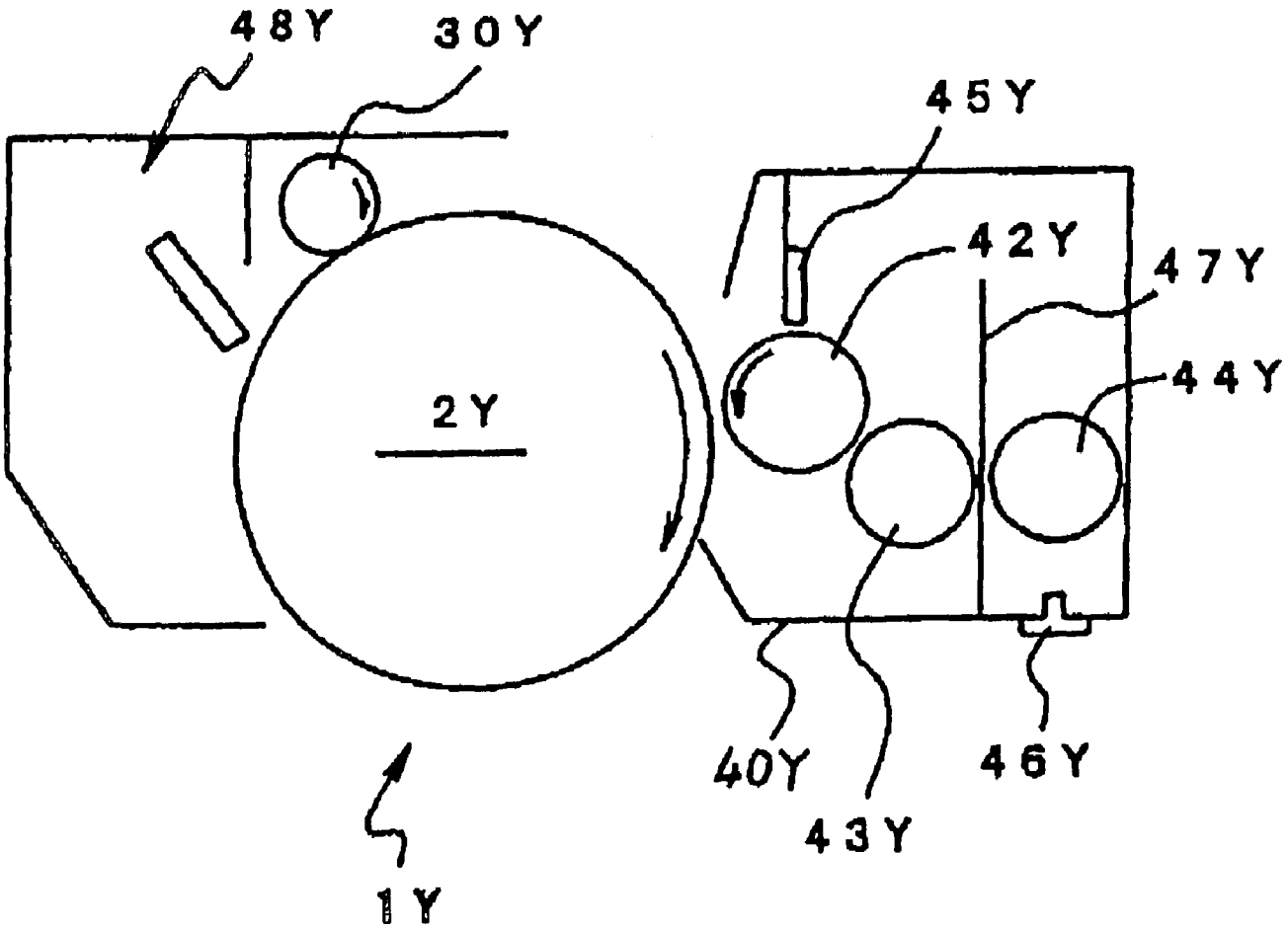
FIG. 10 is a diagram showing the general composition of a yellow processing unit in the aforementioned laser printer.

FIG. 10 shows the general composition of a yellow processing unit 1Y, of the aforementioned processing units 1Y, 1M, 1C and 1K. Since the other processing units 1M, 1C and 1K each have the same composition, separate description of these units is omitted here. In FIG. 10, the processing unit 1Y comprises a drum-shaped photosensitive body 2Y, a charging device 30Y, a developing device 40Y, a drum cleaning device 48Y, and the like.

The charging device 30Y provides the drum surface with a uniform electrical charge, by rubbing a charging roller supplied with an AC voltage against the photosensitive body 2Y. Modulated and polarized laser light is irradiated and scanned by the optical writing unit 10 onto the surface of the charged photosensitive body 2Y. In so doing, a latent electrostatic image is formed on the surface of the drum. The latent electrostatic image thus formed is then developed by the developing device 40Y, thereby creating a yellow toner image.

The developing device 40Y has a developing roller 42Y disposed in such a manner that it is exposed partially via an opening in the casing of the developing device. Furthermore, it also comprises a first conveyance screw 43Y, a second conveyance screw 44Y, a developer ductor 45Y, a toner density sensor (hereinafter, called T sensor) 46Y, and the like.

The two-component developer comprising a magnetic carrier and a negatively charged yellow toner is accommodated inside the casing. This two-component developer is churned and conveyed by the first conveyance screw 43Y and the second conveyance screw 44Y, and becomes charged through friction, whereupon it is carried on the surface of the developing roller 42Y. The thickness of the layer of developer is restricted by the developer ductor 45Y, and it is then conveyed to the developing area opposing the photosensitive body 2Y, where the yellow toner is caused to adhere to the latent electrostatic image on the photosensitive body 2Y. By means of the toner adhering to the latent image in this way, a yellow toner image is formed on the photosensitive body 2Y. The two-component developer after consumption of yellow toner in the developing process is returned to the casing by the rotation of the developing roller 42Y.

A partition 47Y is provided between the first conveyance screw 43Y and the second conveyance screw 44Y. By means of this partition 47Y, the interior of the casing is divided into a first supply section for accommodating the developing roller 42Y and the first conveyance screw 43Y, and the like, and a second supply section for accommodating the second conveyance screw 44Y. The first conveyance screw 43Y is caused to rotate by drive means (not illustrated), and it conveys the two-component developer inside the first supply section from the front side in the drawing towards the rear side, thereby supplying the developer to the developing roller 42Y. The two-component developer conveyed to the vicinity of the end section of the first supply section by the first conveyance screw 43Y is then introduced into the second supply section via an opening (not illustrated) provided in the partition 47Y. In the second supply section, the second conveyance screw 44Y is caused to rotate by drive means (not illustrated), and it conveys the two-component developer moved from the first supply section, in the opposite direction to the first conveyance screw 43Y. The two-component developer conveyed to the vicinity of the end section of the second supply section by the second conveyance screw 44Y is returned to the first supply section via a further opening (not illustrated) provided in the partition 47Y.

The T sensor 46Y, which is a magnetic permeability sensor, is provided in the base wall of the second supply section in the vicinity of the centre thereof, and it outputs a voltage corresponding to the magnetic permeability of the two-component developer passing over it. The magnetic permeability of the two-component developer has a certain correlation to the toner density, and therefore the T sensor 66Y outputs a voltage of a value that corresponds to the density of the yellow toner. This output voltage value is sent to a control section (not illustrated). The control section is provided with a RAM, where it stores a yellow Vtref, which is a target value for the output voltage from the T sensor 46Y. Moreover, it also stores data for a magenta Vtref, a cyan Vtref and a black Vtref, which are target values for the output voltages from T sensors (not illustrated) provided in the other developing devices. The Y Vtref is used to control driving of a yellow toner conveyance device (not illustrated). More specifically, the control section adjusts the supply of yellow toner to the second supply section 49Y by controlling the drive of the yellow toner conveyance device (not illustrate), in such a manner that the value of the output voltage from the T sensor 46Y approaches the value of the yellow Vtref. By adjusting the supply in this way, the density of the yellow toner in the two-component developer held in the developing device 40Y can be maintained within a prescribed range. A similar toner supply control process is implemented in the developing devices of the other processing units, as well.

The yellow toner image formed on the yellow photosensitive body 2Y is transferred onto transfer paper conveyed by a paper conveyance belt, which is described hereinafter. The surface of the photosensitive body 2Y after transferring the image is cleaned of residual toner by a drum cleaning device 48Y, whereupon the charge is removed from the drum by means of a charge removing device (not illustrated). The photosensitive body 20Y is then prepared for the next image formation operation by being charged uniformly by the charging device 30Y. The same applies to the other processing units. Each processing unit is detachable with respect to the printer main body and is replaced when it has reached the end of its useful life.

(Transfer Unit)

In FIG. 9 described above, the transfer unit 11 forming an image transfer device comprises a paper conveyance belt 12, a drive roller 13, a tension roller 14, and four transfer bias rollers 17Y, 17M, 17C and 17K, and the like. The paper conveyance belt 12 is held in a tensed state about the drive roller 13 and the tension rollers 14 and 15, and it is caused to move in an endless fashion in the anti-clockwise direction in the diagram, by means of a drive system (not illustrated). The four transfer bias rollers 17Y, 17M, 17C and 17K are respectively supplied with a transfer bias from a power source (not illustrated). They press the paper conveyance belt 12 from the rear surface thereof towards the photosensitive bodies 2Y, 2M, 2C and 2K, thereby forming respective transfer nips. A transfer electric field is formed between the photosensitive body and the transfer bias roller at each of these transfer nips, due to the effects of the transfer bias. The yellow toner image formed on the yellow photosensitive body 2Y is transferred onto transfer paper P conveyed on the paper conveyance belt 12, due to the effects of the transfer electric field and the nip pressure. Magenta, cyan and black toner images formed respectively on the photosensitive bodies 2M, 2C and 2K are transferred successively and superimposed on this yellow toner image. By means of this superimposed transfer of images, a full colour toner image combined with the white colour of the paper is formed on the transfer paper P conveyed by the paper conveyance belt 12.

(Paper Supply Cassettes)

Three paper supply cassettes 20 for accommodating a plurality of stacked sheets of transfer paper P are provided in a stepped fashion below the transfer unit 11. In each of the cassettes, a paper supply roller presses against the uppermost sheet of transfer paper P. When the paper supply roller is caused to rotate at a prescribed timing, the uppermost sheet of transfer paper P is conveyed into the paper conveyance path.

(Pair of Resist Rollers)

The transfer paper P supplied to the paper conveyance path from a paper supply cassette 20 is sandwiched between a pair of resist rollers 19. The resist rollers 19 feed the transfer paper P sandwiched between them at a timing whereby the toner images can be superimposed mutually in the respective transfer nips. By this means, the toner images are transferred onto the transfer paper P in a superimposed fashion, at the respective transfer nips. The transfer paper P formed with the full colour image is supplied to the fixing unit 21.

(Fixing Unit)

The fixing unit 21 forming a fixing nip by means of a heating roller 21*a* having an internal heating source, such as a halogen lamp, or the like, and a pressurizing roller 21*b* which presses against the heating roller 21*a*. The transfer paper P is sandwiched in the fixing nip and the full colour image is fixed onto the surface of the paper. The transfer paper P having passed through the fixing unit 21 is then output from the machine, via a pair of output rollers (not illustrated).

Next, the characteristic features of the composition of this printer will be described.

Figure 4:
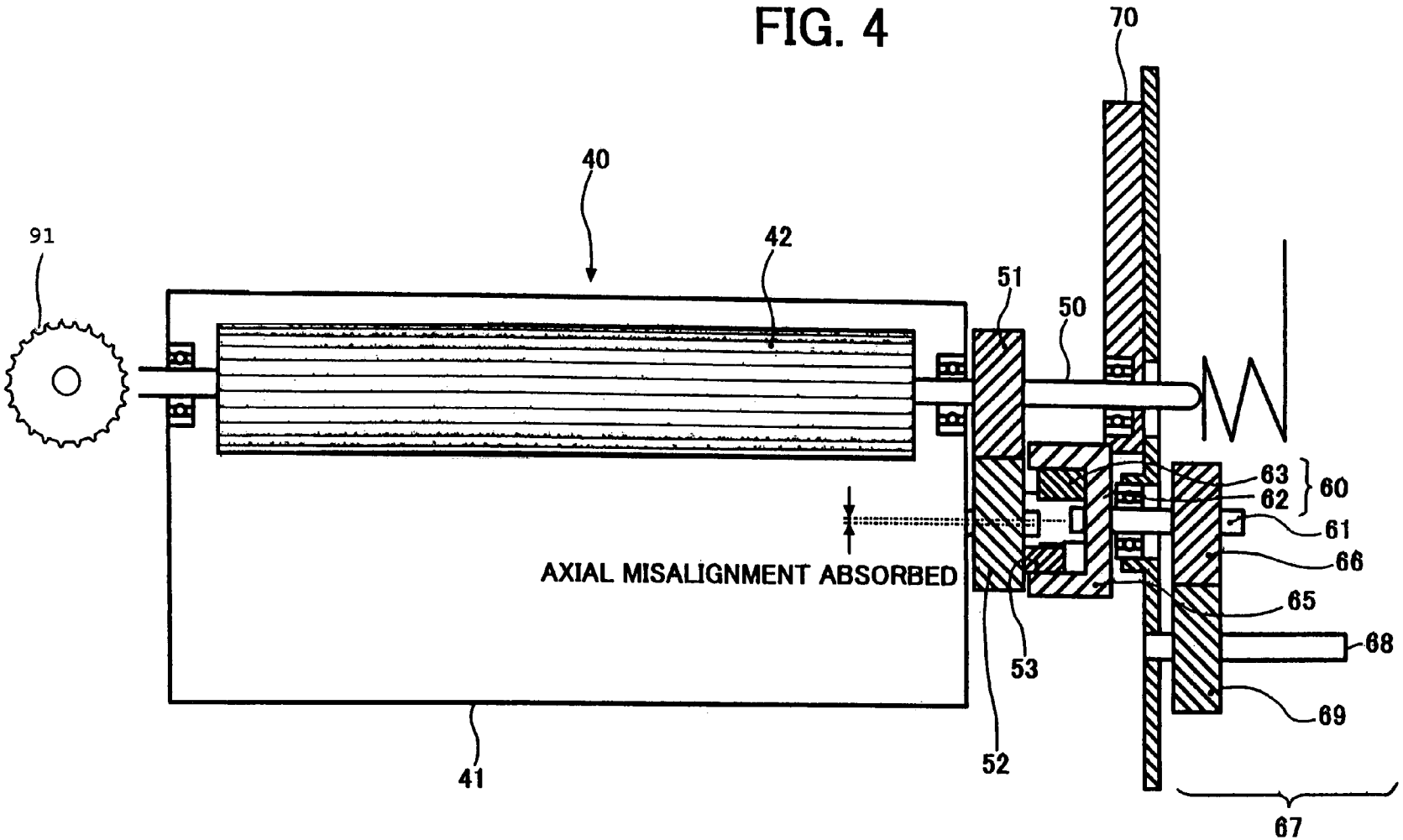
FIG. 4 is a cross-sectional diagram showing the composition of a drive coupling section of a developing device relating to a first embodiment of the present invention.

FIG. 4 shows the composition of a drive coupling section of a developing device relating to a first embodiment of the 5 present invention. As this diagram reveals, the developing device 40 is constituted by a developing roller 42 forming a developer carrier disposed in such a manner that a portion thereof is exposed via an opening in a casing 41, and conveyance screws and a developer ductor, and the like, which are not illustrated. The developing roller axle 50 extends from the interior of the casing 41, via a side face of the casing 41 (the right-hand side in the diagram), and a roller gear 51 is fixed to the developing roller axle 50 outside the casing 41, in such a manner that it rotates in unison with same. A coupling gear 52 meshes with the roller gear 51.

Figure 5A:
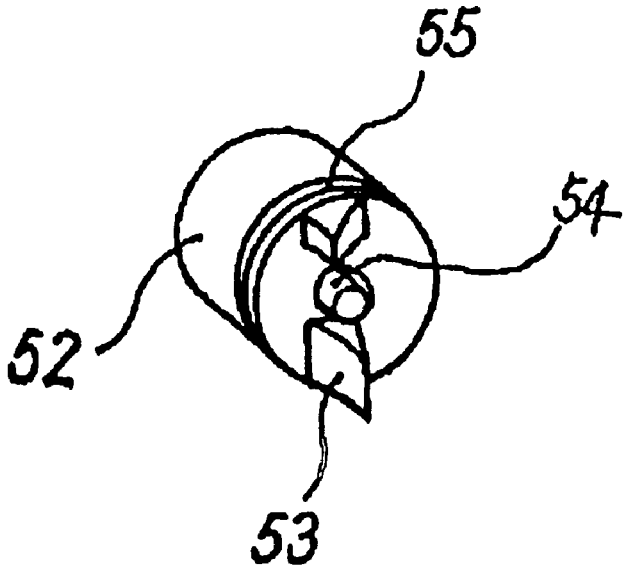
FIGS. 5A and 5B are external oblique views showing the composition of the principal part of this drive coupling section.
Figure 5B:
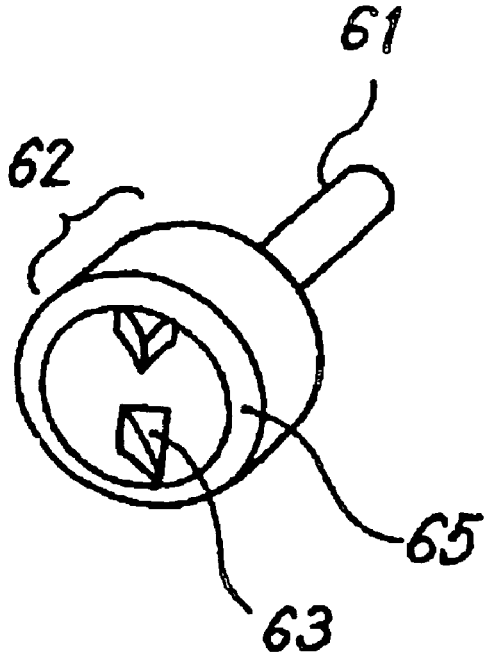

FIG. 5A and FIG. 5B show the external appearance of the coupling gear 52 and a rotational coupling section 62 (described below) which is located in the main body of the printer. As these diagrams indicate, two fingers 53 forming projecting sections are provided in a protruding manner on the end face of the coupling gear 52. Moreover, projections 55 for engaging with recesses 65 provided on the end face of the rotational coupling section 62 on the main body of the printer (described below) are formed on the end face of the coupling gear 52, on the same side where the finger sections are provided. Moreover, as shown in FIG. 5A and FIG. 5B, an opening for inserting a shaft (holding axle) 54 is provided in the central portion of the coupling gear 52. The diameter of this opening section is set to be larger than the diameter of the shaft 54, and the shaft 54 is inserted into the opening section without being fixed to same, thereby supporting the coupling gear 52.

In this first embodiment, the diameter of the opening section in the coupling gear 52 is set to be between 1.0 mm and 0.5 mm larger than the diameter of the shaft 54. By setting the diameter in this manner, a gap is formed between the opening section forming a through hole in the coupling gear 52, which is the rotational coupling section on the driven side, and the shaft 54 which is inserted into this opening. This gap allows the coupling gear 52 to swing in a direction orthogonal to the direction of the axis of rotation of the rotational coupling section 62 on the main body of the printer. Here, in conventional gears also, the diameter of the through hole has been set slightly larger than the diameter of the rotational axle member, in order to avoid situations where the rotational axle member, such as a shaft, cannot be inserted into the through hole provided in the gear member, due to dimensional error in the components. However, this difference between the diameters is generally of the order of several 10 μm, which is much smaller than the difference between the diameter of the opening section of the coupling gear 52 and the diameter of the shaft 54 in the present printer. In other words, the difference between the diameter of the opening section of the coupling gear 52 and the diameter of the shaft 54 in the present printer is much greater than the difference between the diameters of the through hole and the rotational axle member in a conventional gear. By adopting a large difference in diameters of this kind, it becomes possible for the coupling gear 52 to swing in a direction orthogonal to the direction of the axis of rotation.

On the other hand, a drive axle 67 for receiving drive force from a drive motor (not illustrated) is provided in the main body of the printer, as shown in FIG. 4. The drive axle 67, which forms a drive source axle, comprises an axle 68 and a drive gear 69 fixed to this axle 68. The drive gear 69 is composed so as to mesh with a drive output gear 66. The driver output gear 66 is fixed to the drive output axle 60, in such a manner that the drive output axle 60 is caused to rotate by the drive motor, via the drive gear 69. This drive output axle 60 comprises an axle 61 and a rotational coupling section 62 fixed to this end section. The rotational coupling section 62 has two fingers 63 corresponding respectively to the two fingers 53 of the coupling gear 52 provided on the end face thereof. Moreover, as shown in FIG. 5A and FIG. 5B, a recess 65 is provided on the circumferential face of the rotational coupling section 62, at the end face where the fingers 63 are provided.

Figure 6:
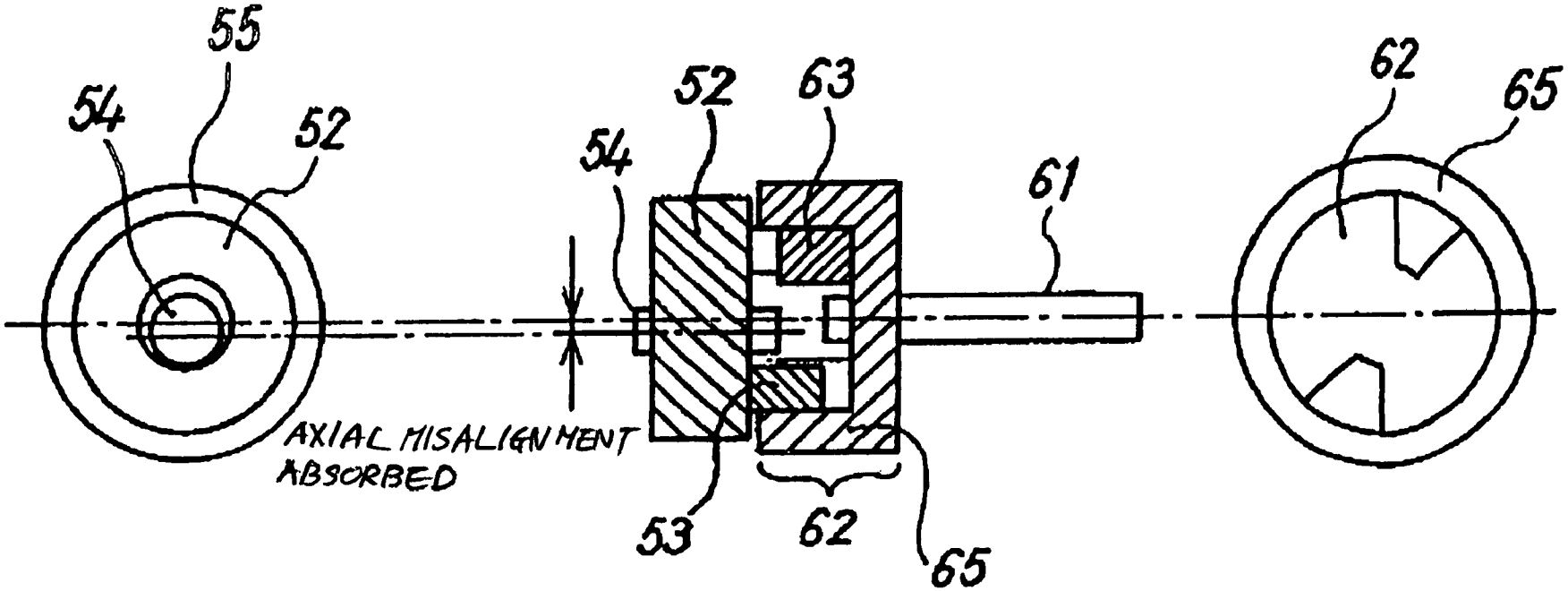
FIG. 6 is a cross-sectional diagram showing the composition of the principal part of the drive coupling section.

When the developing device 40 is installed in the printer, the projection 55 on the coupling gear 52 of the developing device 40 engages with the recess 65 in the rotational coupling section 62 of the drive output axle 60 on the main body of the printer, as illustrated in FIG. 4 and FIG. 6. In conjunction with this, the two fingers 53 and the two fingers 63 catch on each other, thereby coupling the rotational coupling section 62 on the drive output axle 60 with the coupling gear 52. An axle joint is formed by the end structure of the coupling gear 52 and the rotational coupling section 62 forming the end structure of the drive output axle 60. The rotational drive force of the drive output axle 60 is conveyed to the coupling gear 52 by means of this axle joint. The rotational drive force is transmitted to the roller gear 51 that meshes with the coupling gear 52, and hence the developing roller 42 is caused to rotate.

The coupling gear 52 is fixed by meshing with the rotational coupling section 62, in such a manner that its position can be adjusted finely. In other words, rather than providing an axle that is fixed to the coupling gear 52 and rotates in unison with same, as in the prior art, here the coupling gear 52 is allowed a small margin of movement with respect to the developing device, before it engages with the rotational coupling section 62 provided in the main body of the printer. By engaging with the rotational coupling section 62, the centre of rotation of the coupling gear 52 moves to a position on the axis of the axle 61 forming the rotating axle of the rotational coupling section 62, thereby correcting its position. By adopting a composition of this kind, it is possible for any slight misalignment occurring between the central axes of the coupling gear 52 and the rotational coupling section 62, due to problems with precision in the components or design, to be absorbed by the coupling gear 52. Therefore, the coupling gear 52 on the developing device side always rotates about the centre of rotation of the rotational coupling section 62. As a result of this, the rotational coupling section 62 on the printer main body and the coupling gear 52 rotate about the same axis. Consequently, no variation occurs in the rotational speed of the developer carrier due to misalignment of the central axes, and hence there is no variation in the amount of toner conveyed to the developing position, namely, the position where the developer carrier opposes the latent image carrier, per unit time, and unevenness in the developing density can be prevented.

When observed at very small dimensions, for instance, at the order of nanometres (nm), it is difficult to make the axes of the coupling gear 52 and the rotational coupling section 62 coincide completely. However, from the viewpoint of the mechanical design of a drive transmission system using gears, even if there is a misalignment of the central axes in the range of 0.01 to 0.1 mm, the axes can still be regarded to be the same, without causing any problems. In the present invention, the concept "rotating about the same axis" includes axial misalignment of this degree.

Figure 11:
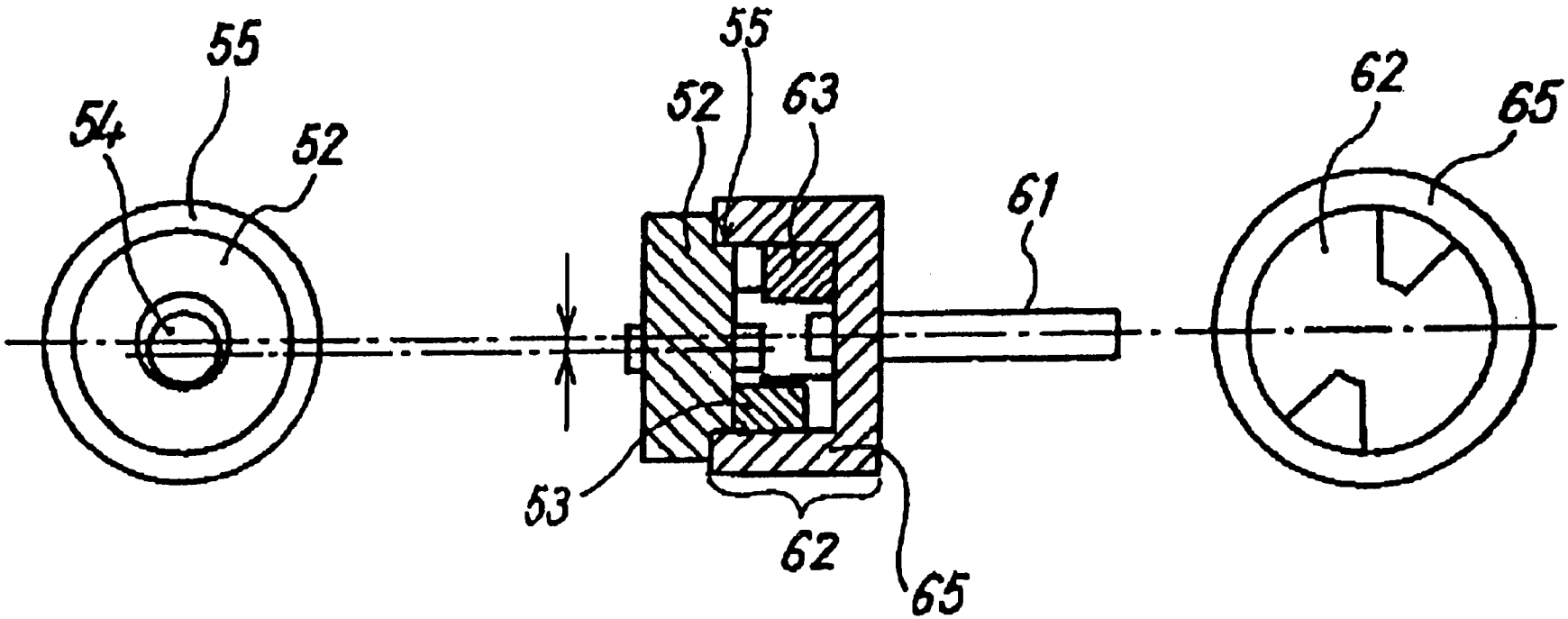
FIG. 11 is a diagram showing the state of engagement between the coupling gear and the rotational coupling section shown in FIG. 5.

As shown in FIG. 6, in the combination of the coupling gear 52 and the rotational coupling section 62, it is also possible to make the fingers 53 on the coupling gear 52 engages with the recess 65 in the rotational coupling section 62, as illustrated in FIG. 6. However, a more reliable engaging action is obtained if the coupling gear 52 is formed such that its diameter on the front end side is smaller than its diameter on the base end side, a projection 55 being provided on the front end and this projection 55 being made to engage with a round tubular recess in the rotational coupling section 62, as shown in FIG. 5A and FIG. 5B. For reference purposes, the state of engagement between the coupling gear 52 and the rotational coupling section 62 shown in FIG. 5A and FIG. 5B is illustrated in FIG. 11.

In a conventional Oldham coupling, there are two reasons why misalignment of the central axes causes variation in the rotational speed of the rotating body, such as the developing roller. The first reason is that the axial misalignment causes variation in the amount of drive force transmitted from the rotational coupling section on the drive source side to the rotational coupling section on the driven side. More specifically, if there is axial misalignment, then during one rotation of the rotational coupling section on the drive side, the amount of drive force transmitted to the rotational coupling section on the driven side, per unit of rotational travel, will vary depending on the rotational position. In general, when the central axes are misaligned, the amount of drive force transmitted to the rotational coupling section on the driven side per unit of rotational travel increases gradually as the amount of rotation increases, in the region from the prescribed rotational reference position of the rotational coupling section on the drive side until a position reached by a 180° rotation from that reference position. On the other hand, in the region from the 180° position until the 360° position, the amount of drive force transmitted to the rotational coupling section on the driven side per unit of rotational travel decreases gradually as the amount of rotation increases. In this way, the amount of drive force transmitted to the rotational coupling section on the driven side varies with the rotational position of the rotational coupling section on the drive side, thereby giving rise to variation in the speed of the rotational body.

However, by means of the combination of the coupling gear 52 and the rotational coupling section 62 in the present printer, misalignment of the central axes is eliminated. Therefore, it is possible to avoid situations where the amount of drive force transmitted to the coupling gear 52 on the driven side per unit of rotational travel varies with the rotational position of the rotational coupling section 62 on the drive side, and hence the developing roller 42 can be caused to rotate at a stable speed.

The second reason why misalignment of the central axes causes variation in the rotational speed of a rotating body, such as a developing roller, in a conventional Oldham coupling is because the load on the rotational drive source, such as a motor, varies with the rotational position of the rotational coupling section on the drive side. More specifically, in a conventional Oldham coupling, a groove-shaped recess is formed on one end section of the respective rotational coupling sections, and a projection for engaging with this groove-shaped recess, slidably in the longitudinal direction of the groove, is provided on the other end section. By means of the projection slidably inside the recess in the longitudinal direction of the groove, in accordance with the rotation of the rotational coupling section on the drive side, a state is produced where no misalignment of the central axes occurs. By this means, even if there is axial misalignment between the respective rotational coupling sections, rotation via coupling of the respective rotational coupling sections can still be achieved. In an Oldham coupling having a composition of this kind, during one rotation of the rotational coupling section on the drive side, there arise rotational positions at which the frictional force between the projection and the groove-shaped recess is large, and rotational positions at which this frictional force is small. At a rotational position where the frictional force is large, a strong force acts seeking to bend the rotating axle of the rotational coupling section on the drive side in a direction orthogonal to the axial direction thereof, but since this force is used to cause the projection to make a sliding movement, the two rotational coupling sections are caused to rotate in whatever way possible. As a result of this, the load on the rotational drive source, such as the motor, varies with the rotational position of the rotational coupling section on the drive side, and hence the amount of drive force transmitted from the drive side to the driven side changes. In this way, in a conventional Oldham coupling, two rotational coupling sections whose central axes are misaligned are caused to rotate forcibly, by means of the sliding movement of the projection, rather than achieving rotation of the two rotational coupling sections by eliminating axial misalignment.

By contrast, by means of the combination of the coupling gear 52 and the rotational coupling section 62 in the present printer, the two elements are made to rotate whilst eliminating axial misalignment between same. Therefore, it is possible to avoid situations where the load on the rotating drive source, such as the motor, changes with the rotational position of the rotational coupling section 62 on the drive side, and hence variation in the rotational speed of the developing roller 42 caused by variation in the load can be eliminated.

The drive output axle 60Y forming a drive axle is made from an electrically conductive material, and it supplies a developing bias from the printer main body, via an electrode. Since the developing bias is supplied from the drive output axle 60Y which rotates in unison with the developing roller 42, it is possible to prevent connection failures (contact failures).

The photosensitive body 2 is composed in such a manner that it is positioned with respect to the side plates 70 of the printer main body by means of a method similar to that described above, or by means of a known method. Thereby, the developing roller 42 and the surface of the photosensitive body are made to oppose each other via a prescribed gap.

In each of the processing units, desirably, the gap between the photosensitive body 2 and the developing roller 42 is 0.4 mm or less. Thereby, it is possible to improve the graininess of the developed toner image significantly, thus yielding an image of higher quality, compared to cases where a larger gap is allowed. If the gap is narrowed in this way, then unevenness in the developing density due to variation in the rotational speed of the developing roller is more liable to occur, but since rotational speed variation of this kind is suppressed in the present printer, it is possible effectively to suppress image deterioration caused by uneven developing density.

Moreover, desirably, the amount of two-component developer picked up by the roller is equalized by forming V-shaped or other shaped grooves 91 in the surface of the developing roller 42, or by roughening the surface of the developing roller 42 by sandblasting. In so doing, it is possible to suppress not only unevenness in the developing density caused by rotational speed variation in the roller, but also unevenness in the developing density caused by variation in the amount of toner carried by the roller. In general, it is desirable to provide grooves, such as V grooves, in the developing roller, rather than subjecting the roller to sandblasting, since this option allows stable conveyance of the developer without causing abrasion, even in the case of prolonged use.

Furthermore, the carrier forming magnetic particles is created by providing a resin coating on magnetic core particles, and for this resin coating, it is desirable to use a resin component obtained by cross-linking a thermoplastic resin, such as acrylic, with a melamine plastic, and incorporating a charge adjusting agent. A conventional carrier is composed in order to obtain long life with the hard coating film gradually being worn away, but in the case of the present carrier, impacts are absorbed by the elastic properties of the coating layer and hence loss of the film is restricted. Consequently, even longer life than a conventional carrier can be achieved. By this means, it is possible to ensure that the amount of toner carried by the roller remains stable over a long period of time. In other words, stable quality can be expected.

Furthermore, in the first embodiment, a carrier having an average particle size of between 20 (μm) and 60 (μm) was used. If a magnetic carrier having a small particle size of 60 (μm) or less is used, then variation in the trace of the magnetic carrier and the half-tone images, in other words, deterioration of the graininess, can be prevented, and hence dot reproducibility can be improved and high image quality can be achieved. Moreover, using a magnetic carrier having a particle size of 20 μm or above prevents excessive decline in the fluid properties and stress in the developer.

Furthermore, desirably, an oil-based toner containing an oil component is used. The reasons for this are as follows. Namely, in a fixing system using an oil-free polymer toner, it is not possible to obtain glossy images, and therefore oil must be coated onto the fixing rollers in order to achieve a glossy effect. In this case, unevenness in the gloss on the image is liable to occur due to unevenness in the oil coating applied to the fixing rollers. On the other hand, if a toner containing oil is used, then it is possible to achieve a glossy appearance naturally, by means of the oil being released from the toner particles upon fixing. Therefore, unevenness in the gloss effect caused by unevenness in the oil coating can be avoided. One example of a toner containing oil is the following toner. More specifically, firstly, a pre-polymer consisting of a resin in an organic solvent is taken, and a compound which extends or cross-links with this pre-polymer, and a toner material, are dissolved or dispersed in the pre-polymer. Then, a cross-linking or extension reaction is induced in the medium, and a toner is obtained by removing the solvent from the dispersed liquid.

Furthermore, desirably, a low-melting-point toner having a melting point of around 140° C. is used. Since this type of toner can be fixed at a lower temperature than a conventional toner, the fixing means can be starting up quickly and the hence energy savings can be made.

In FIG. 4 described previously, when the developing device 40 is installed in the main body of the printer, the developing roller axle 50 which extends significantly from the interior of the casing 41 is inserted into a positioning bearing provided in the side plate 70 of the printer main body. Thereby, the developing device 40 is positioned with respect to the printer main body, and hence with respect to the photosensitive body, by taking the developing roller 42 as a reference. In other words, by engaging the developing roller axle 50 provided on one end of the roller gear 51 forming a transmission gear with a positioning bearing forming a positioning section, the developing roller 42 is positioned with respect to the printer main body. By means of positional registration of this kind, the developing gap between the developing roller 42 and the photosensitive body is set accurately, and therefore it is possible to suppress variation in the developing performance between different products due to assembly errors.

If the developing device 40 is positioned with respect to the printer main body in this way, by taking the developing roller 42 as a reference, then there will be slight misalignment between the central axes of the coupling gear 52 and the rotational coupling section 62, due to dimensional errors in the various components, errors in the hole positions, or the like. If, conversely, a composition is adopted wherein the developing device 40 is positioned by taking the coupling gear 52 as a reference, with the objective of eliminating this axial misalignment, then it becomes impossible to set the developing gap accurately. However, in the present printer, it is possible to resolve both axial misalignment and variation in the developing gap, which are linked by trade off relationship in this way. The variation in the developing gap is eliminated by positioning the developing roller 42 by taking the developing roller 42 as a reference, and the axial misalignment is eliminated by adjusting the position of the coupling gear 52 as described above.

In the present printer, even if the position of the coupling gear 52 is corrected when it engages with the rotational coupling section 62 on the drive side, the gap between the opening section of the coupling gear 52 and the shaft 54 inserted therein is maintained. By fixing the coupling gear 52 after its position has been corrected, whilst it maintains an engaged state with respect to the rotational coupling section 62, the non-contact state between the coupling gear 52 and the shaft 54 is preserved. In this composition, it is possible to avoid situations where a large load is applied to the rotational drive source, such as the motor, due to contact between the shaft 54 and the inner walls of the opening section of the coupling gear 52 after its position has been corrected. Moreover, it is also possible to avoid unevenness in the developing density due to vibrations being generated by friction between the shaft 54, held in a non-rotatable state, and the inner walls of the opening in the coupling gear 52, which is driven so as to rotate, and these vibrations being transmitted to the developing roller 42 via the casing of the developing device 40 and the developing roller axle 50.

Next, a modification of the positioning structure for the developing roller with respect to the printer main body will be described.

Figure 7:
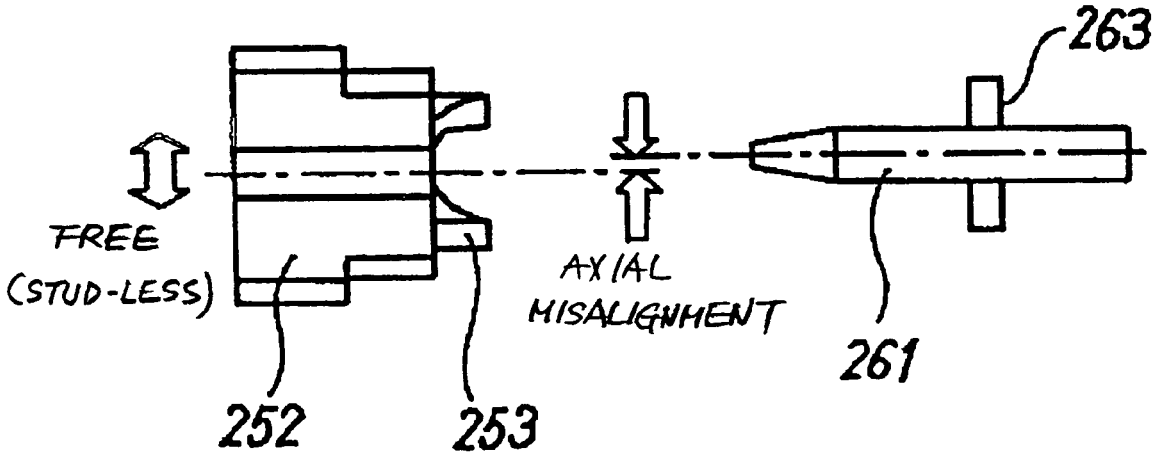
FIGS. 7 and 8 are diagrams showing the composition of a drive coupling section of a developing device relating to one modification relating to the first embodiment.
Figure 8:
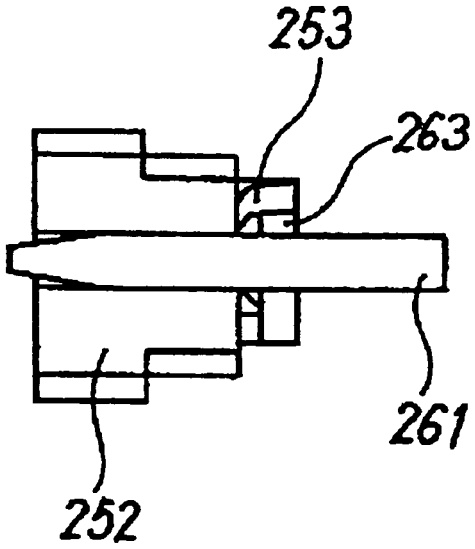

FIG. 7 and FIG. 8 show the general composition of a drive coupling section of a developing device relating to this modification. The basic composition and operation of this drive coupling section is similar to that in the first embodiment described above, and before the rotational coupling section on the developing device side is engaged with the rotational coupling section on the printer main body, the rotational coupling section on the developing device side is able to move within a small range with respect to the developing device. Below, the points of difference with respect to the first embodiment will be described.

In the first embodiment described above, a shaft 54 fixed to the developing device is inserted into an opening section provided in the central portion of the coupling gear 52, but in the present modification, this shaft 54 is not provided. Instead of this, an opening section 255 for engaging with a drive output shaft section 261 in the printer main body (described hereinafter), is provided in the central region of the coupling gear 252. Moreover, in the first embodiment described above, the coupling gear 52 was supported by the shaft 54, but in the present modification, no shaft is provided for supporting the coupling gear 252, but rather, it is supported by a frame composed in such a manner that it is movable within a small range.

Furthermore, in the first embodiment described above, the drive output axle 60 formed by the axle 61 and the rotational coupling section 62 engaged with a coupling gear 52 on the developing device side, but in the present modification, the drive output shaft 261 is composed in such a manner that it engages with the coupling gear 252 on the developing device side. The drive output shaft 261 has a taper on the front end side where it engages with the coupling gear 252, as illustrated in FIG. 7, in order that it may engage smoothly with same. Moreover, in the first embodiment described above, two fingers 63 corresponding respectively to two fingers 53 on the coupling gear 52 were provided on the end face of the rotational coupling section 62 on the printer main body, but in the present modification, fixed pins 263 passing through the drive output shaft 263 are provided instead of the fingers 63.

When the developing device is installed in the printer, the opening section 255 of the coupling gear 252 on the developing device side engages with the front end section of the drive output shaft section 261 in the printer main body, as illustrated in FIG. 8. In conjunction with this, the two fingers 253 engage with the fixed pins passing through the drive output shaft 261, thereby coupling the drive output shaft 261 with the coupling gear 252. An axle joint is formed by the end structure of the coupling gear 252 and the drive output shaft 261. This axle joint transmits the rotational drive force of the drive output shaft 261 to the coupling gear 252. The rotational drive force is then transmitted to a roller gear 51 (not illustrated) that meshes with the coupling gear 252, thereby causing the developing roller 42 to rotate.

Figure 15:
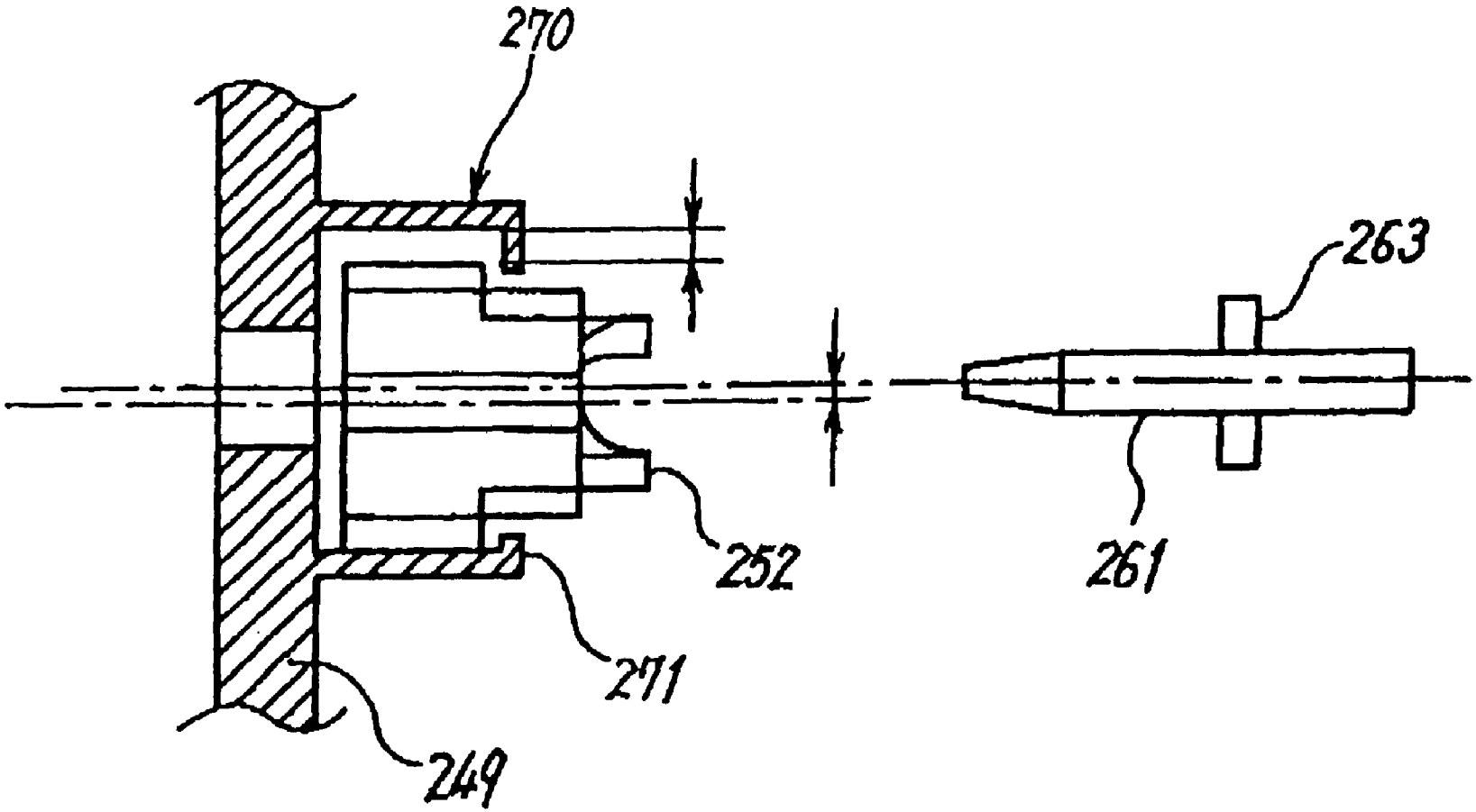
FIG. 15 is a diagram showing a drive output shaft and coupling gear prior to engagement, and a side plate of a developing device, in a printer relating to a modification of the third embodiment.
Figure 16:
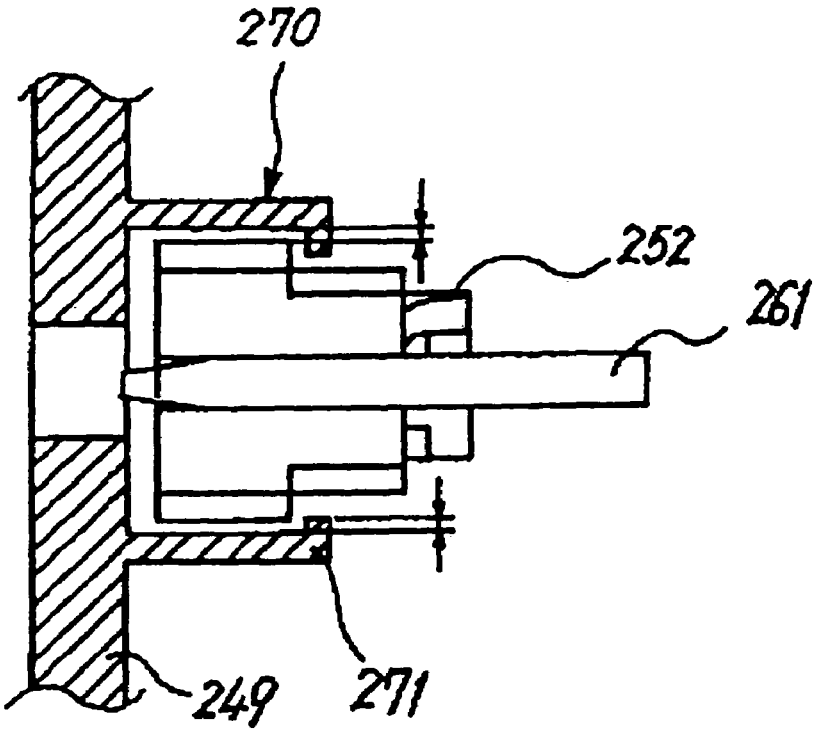
FIG. 16 is a diagram showing a drive output shaft and coupling gear after engagement, and a side plate of a developing device, in this printer.
Figure 17:
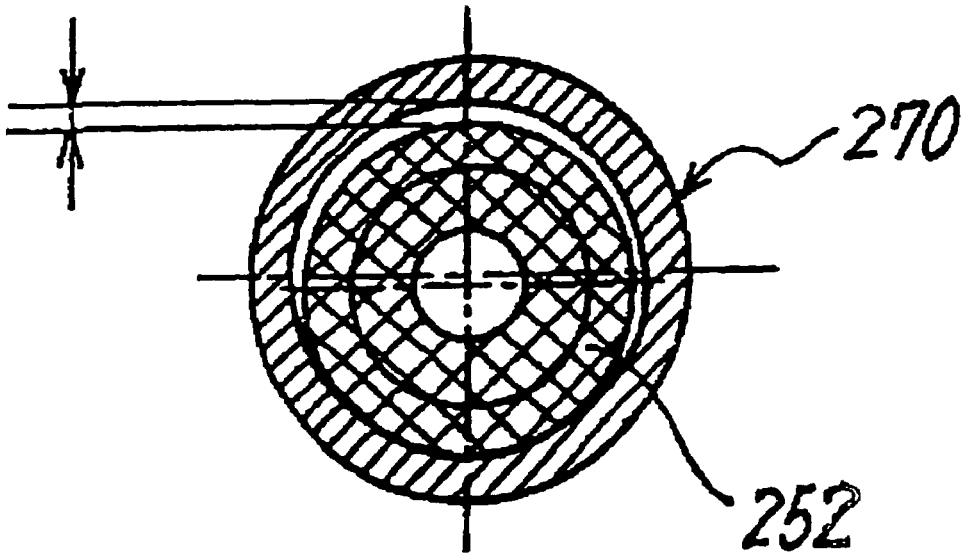
FIG. 17 is a lateral cross-sectional view showing the composition of a gear carrying section in the side plate, and a gear carrying section.

FIG. 15 shows the drive output shaft 261 and the coupling gear 252 in the printer according to the present modification, before they are mutually engaged, as well as the side plate 249 of the developing device. Moreover, FIG. 16 shows the drive output shaft 261 and the coupling gear 252 in the printer according to the present modification, after they have been mutually engaged, as well as the side plate 249 of the developing device. FIG. 17 shows a gear holding section 250 of the side plate 249 and the coupling gear 252. The coupling gear 252 is fixed by engaging with the drive output shaft 261, in such a manner that slight positional adjustment can be made.

More specifically, in the printer according to the present modification, a gear holding section 270 is formed projecting from the side of the side plate 249 of the developing device. This gear holding section 270 has a circular tubular structure and has a cylindrical internal cavity. The diameter of this cylindrical cavity is greater than the diameter of the outer circumferential surface of rotation of the coupling gear 252 which forms the rotational coupling section on the driven side. The coupling gear 252 is held in the cylindrical cavity of the of the gear holding section 270, and it engages with the drive output shaft 261 forming the rotational coupling section on the drive side, which is inserted into an opening section forming a through hole passing through the coupling gear 252 in the direction of rotation. A projecting section 271 projecting in a ring shape towards the inside of the cylinder is provided in the gear holding section 270, at the end thereof in the direction of the axis of the cylinder. This projecting section 271 has a smaller internal diameter than the diameter of the outer circumferential surface of the coupling gear 252, and it serves to prevent the coupling gear 252 held in the cylindrical cavity from becoming detached from the cavity. Even if the coupling gear 252 swings in the direction of the cylinder axis inside the cylindrical cavity of the gear holding section 270, the coupling gear 252 is prevented from becoming detached from the cylindrical cavity by abutting against the projecting section 271 of the gear holding section 270.

As shown in FIG. 17, this coupling gear 252 is held movably in at least a plane orthogonal to the direction of the axis of rotation, by means of the gap between the outer rotational circumferential surface and the cylindrical cavity. Therefore, the position of the coupling gear 252 can be corrected by moving it along the axis of rotation of the drive output shaft 261, as it engages with the drive output shaft 261. In other words, the coupling gear 252 is not provided with an axle fixed to the coupling gear 252 so as to rotate in unison with same, as in the prior art, but rather, before it is engaged with the drive output shaft 261 on the printer main body, it is disposed movably within a small range with respect to the developing device. By engaging with the drive output shaft 261, the coupling gear 252 is positioned.

By adopting a composition of this kind, it is possible for any slight misalignment occurring between the central axes of the coupling gear 252 and the drive output shaft 261 due to problems with precision in the components or design, to be absorbed by the coupling gear 252. Therefore, the coupling gear 252 on the developing device side always rotates about the centre of rotation of the drive output shaft 261. As a result of this, no variation occurs in the rotational speed of the developer carrier due to misalignment of the central axes, and hence there is no variation in the amount of toner conveyed to the developing position, namely, the position where the developer carrier opposes the latent image carrier, per unit time, and unevenness in the developing density can be prevented.

The diameter of the cylindrical cavity in the gear holding section 260 is set to 0.5 to 1.0 mm greater than the diameter of the outer rotational circumferential surface of the coupling gear 252. Therefore, a gap is formed between the inner wall of the cylindrical cavity of the gear holding section 260 and the coupling gear 252 held in same, and this means that the coupling gear 252 is able to swing in a direction orthogonal to the axis of rotation of the coupling gear 252, as it engages with the drive output shaft 261.

In the present modification, even if the position of the coupling gear 252 is corrected as it is engaged with the drive output shaft 261 forming the rotational coupling section on the drive side, a gap is still maintained between the cylindrical inner wall of the gear holding section 270 and the coupling gear 252. By fixing the coupling gear 252 after its position has been corrected, whilst maintaining it in an engaged state with respect to the drive output shaft 261, the two elements are kept in a non-contact state. In this composition, it is also possible to avoid unevenness in the developing density due to vibrations being generated by friction between the gear holding section 270, fixed in a non-rotatable state, and the coupling gear 252, which is driven so as to rotate, and these vibrations being transmitted to the developing roller via the casing of the developing device and the developing roller axle.

The coupling gear 252 shown in FIG. 15 to FIG. 17 has a cylindrical opening section which does not change diameter from the shaft input side to the shaft output side. Instead of this opening section, it is also possible to adopt an opening section having a taper on the input side whereby the diameter becomes smaller towards the output side. In an opening section of this kind, even if there is a large misalignment between the centre of the opening section of the coupling gear 252 before engagement and the centre of the drive output shaft 261, then the front end of the drive output shaft 261 abuts against the broad input side of the opening and the drive output shaft 261 can then be inserted smoothly into the opening section.

Next, a printer relating to a second embodiment where the present invention is applied will be described. Except where stated otherwise below, the composition of the printer is similar to the printer relating to the first embodiment.

Figure 12:
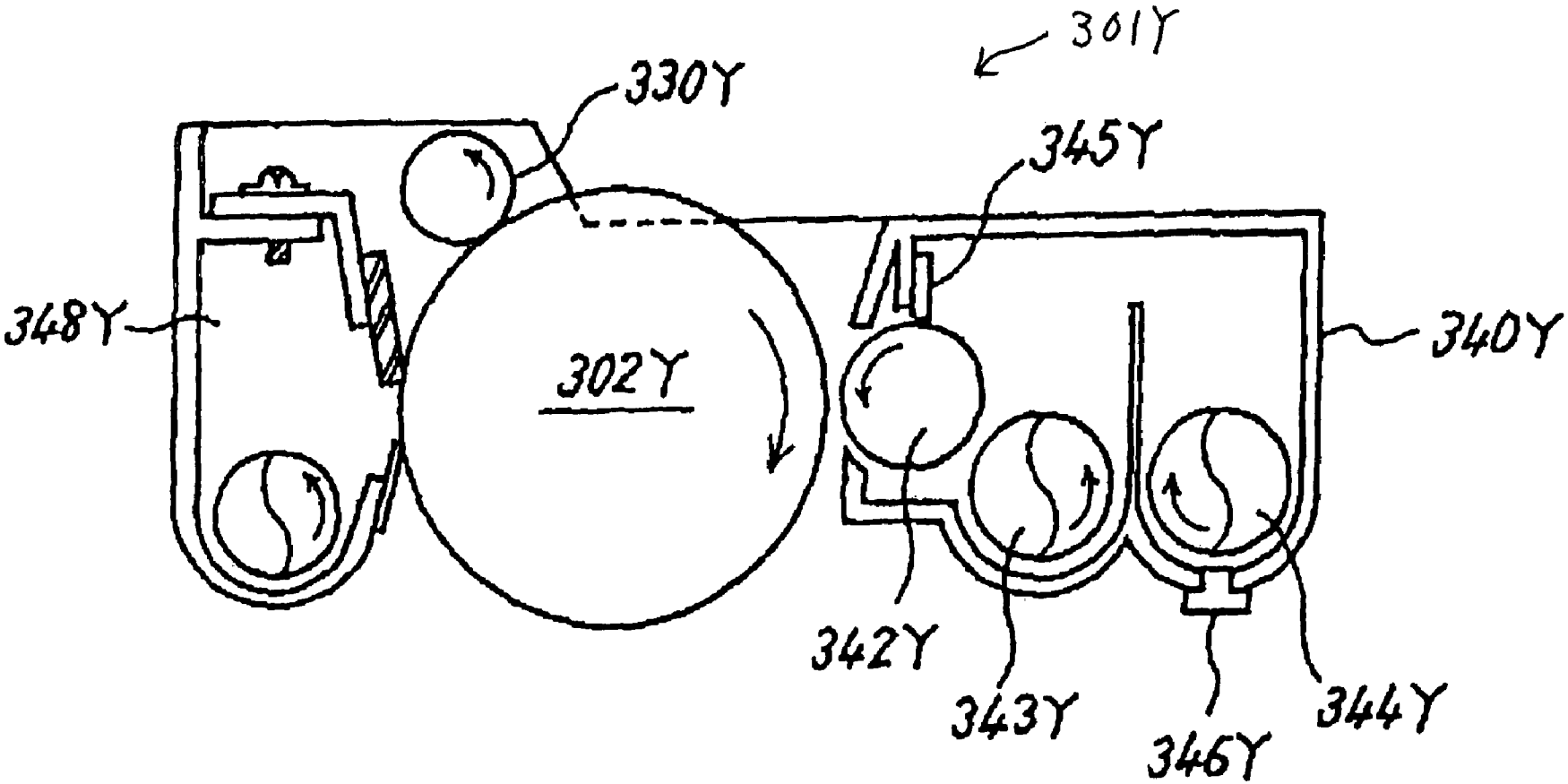
FIG. 12 is a diagram showing the composition of a yellow processing unit of a printer relating to a second embodiment of the present invention.

FIG. 12 shows the composition of a yellow processing unit 301Y of this printer. As this diagram illustrates, the processing unit 301Y comprises a developing device 340Y, a charging device 330Y, a drum cleaning device 348Y, and the like, disposed about a drum-shaped photosensitive body 302Y. These elements are held in a casing which forms a common supporting body, and are detachable from the printer main body, in an integrated fashion as a single unit.

Figure 13:
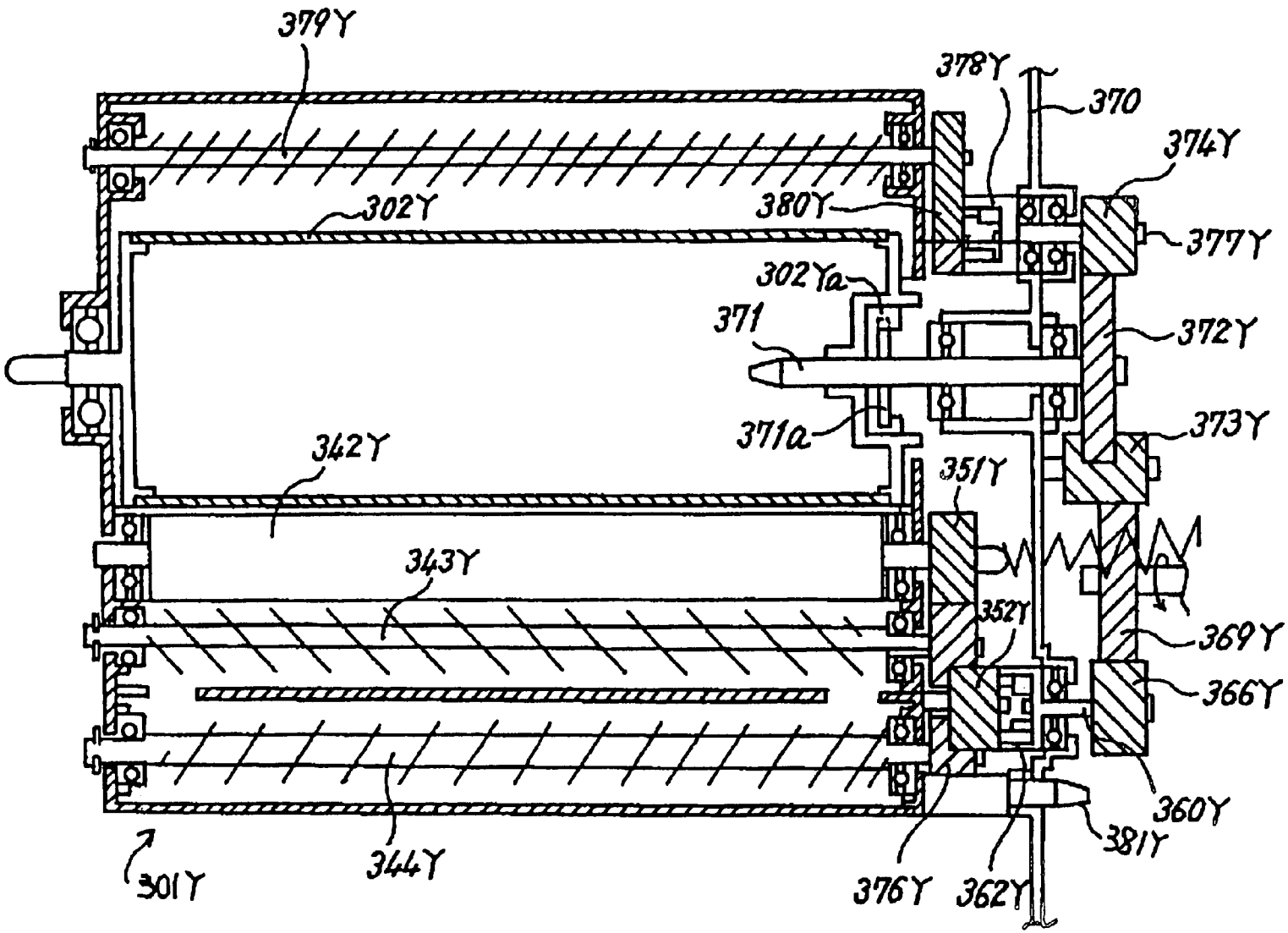
FIG. 13 is a plan view cross-sectional diagram showing the composition of this processing unit and side plates of the main body of the printer.

FIG. 13 shows a yellow processing unit 301Y and a printer main body side plate 370. A shaft hole for inserting a drum drive shaft 371Y supported rotatably by the printer main body side plate 370 is provided in the centre of the drum of the photosensitive body 302Y of the processing unit 301Y. The drum drive shaft 371Y has a pin 371*a* projecting beyond the rotating surface of photosensitive body 302Y at a position on the base end side which is not inserted into the shaft hole, and by means of this pin catching on a projection 302Y*a* of the photosensitive body 302Y and causing it to rotate, rotational drive force is transmitted to the photosensitive body 302Y.

A drum drive gear 372Y is fixed to the rear end side of the drum drive shaft 371Y. An intermediate gear 373Y and a second drive output gear 374Y mesh with this drum drive gear 372Y. The intermediate gear 373Y also meshes with a drive gear 369Y, in addition to the drum drive gear 372Y, and the drive gear 369Y meshes further with a first drive output gear 366Y.

The drive gear 369Y is the uppermost gear which is driven in rotation by a motor (not illustrated), and it transmits rotational drive force to the respective gears. The first drive output gear 366Y which meshes with the drive gear 369Y is fixed to the rear end of the first drive output axle 60, and a first rotational coupling section 362Y on the drive side is fixed to the front end of the first drive output axle 360Y.

The first rotational coupling section 362Y transmits rotational drive force to two screws 343Y and 344Y in the developing device 340Y, and to a developing roller 342Y. The developing device 340Y has a first coupling gear 352Y forming a driven side rotational coupling section, which meshes with the first rotational coupling section 362Y. The first rotational coupling section 362Y and the first coupling gear 352Y respectively have the same composition as the rotational coupling section (62) and the coupling gear (52) of the printer relating to the first embodiment. The position of the first coupling gear 352Y is corrected as it engages with the first rotational coupling section 362Y, thereby forming a mechanism whereby any axial misalignment between the two elements is eliminated.

A first screw gear 375Y and a second screw gear 376Y mesh with the first coupling gear 352Y. The first screw gear 375Y and the second screw gear 376Y are fixed to the ends of the first conveyance screw 343Y and the second conveyance screw 344Y. The rotational drive force from the first rotational coupling section 323Y is transmitted via the first coupling gear 352Y to the first screw gear 375Y and the second screw gear 376Y, thereby causing the first conveyance screw 343Y and the second conveyance screw 344Y to rotate. A roller gear 351Y also meshes with the first screw gear 375Y, and by transmitting rotational drive force to this gear, the developing roller 342Y is caused to rotate.

The rotational drive force of the uppermost drive gear 396Y is transmitted successively to the intermediate gear 373Y, the drum drive gear 372Y, and the second drive output gear 374Y. The second drive output gear 374Y is fixed to the rear end of the second drive output axle 377Y, and a second drive side rotational coupling section 378Y is fixed to the front end of the second drive output axle 377Y.

The second rotational coupling section 378Y transmits the rotational drive force a recovery screw 378Y of the drum cleaning device 348Y. The developing device 340Y has a second coupling gear 380Y forming a driven side rotational coupling section which meshes with the second rotational coupling section 378Y. The second rotational coupling section 378Y and the second coupling gear 380Y respectively have a similar composition to the rotational coupling section (62) and the coupling gear (52) of the printer relating to the first embodiment. The position of the second coupling gear 380Y is corrected as it engages with the second rotational coupling section 378Y, thereby forming a mechanism whereby axial misalignment between the two elements is eliminated.

In the printer having the foregoing composition, it is also possible to eliminate the following type of speed variation, in addition to the rotational speed variation in the developing roller 342Y caused by misalignment between the central axes of the first rotational coupling section 362Y and the first coupling gear 352Y. More specifically, this type of speed variation is variation in the rotational speed of the first conveyance screw 343Y and the second conveyance screw 344Y, caused by axial misalignment. Furthermore, variation in the rotational speed of the recovery screw 379Y due to misalignment between the central axes of the second rotational coupling section 378Y and the second coupling gear 380Y can also be eliminated.

In the present printer, even if the position of the first coupling gear 352Y is corrected as it engages with the first rotational coupling section 362Y on the drive side, the gap between the opening section of the first coupling gear 252Y and the shaft inserted into same is still maintained. By fixing the first coupling gear 252Y after its position has been corrected, whilst maintaining it in an engaged state with the first rotational coupling section 362Y, the two elements are kept in a non-contact state.

Moreover, similarly, the second coupling gear 380Y is kept in a non-contact state with respect to the shaft inserted into the opening section therein. Therefore, it is also possible to avoid unevenness in the developing density due to vibrations being generated by friction between the shaft, held in a non-rotatable state, and the first coupling gear 252Y, which is driven so as to rotate, and these vibrations being transmitted to the photosensitive body 302Y via the casing of the processing unit 301Y and the drum drive shaft 371Y.

Moreover, it is also possible to avoid unevenness in the developing density due to vibrations being generated by friction between the shaft, held in a non-rotatable state, and the second coupling gear 280Y, which is driven so as to rotate, and these vibrations being transmitted to the photosensitive body 302Y via the casing of the processing unit 301Y and the drum drive shaft 371Y.

In this printer, the photosensitive body 302Y is positioned inside the main body of the printer by means of the drum drive shaft 371 in the printer main body being inserting into a shaft hole of the photosensitive body 302Y. Moreover, the processing unit 301Y, and hence the developing roller 342Y, is positioned inside the main body of the printer by means of a positioning pin 381Y projecting from the side plate of the processing unit 301Y engaging with a positioning hole provided in the side plate 370 of the printer main body.

Next, a printer relating to a third embodiment to which the present invention is applied will be described. Except where specified otherwise below, the composition of this printer is similar to the printer relating to the first embodiment.

Figure 14:
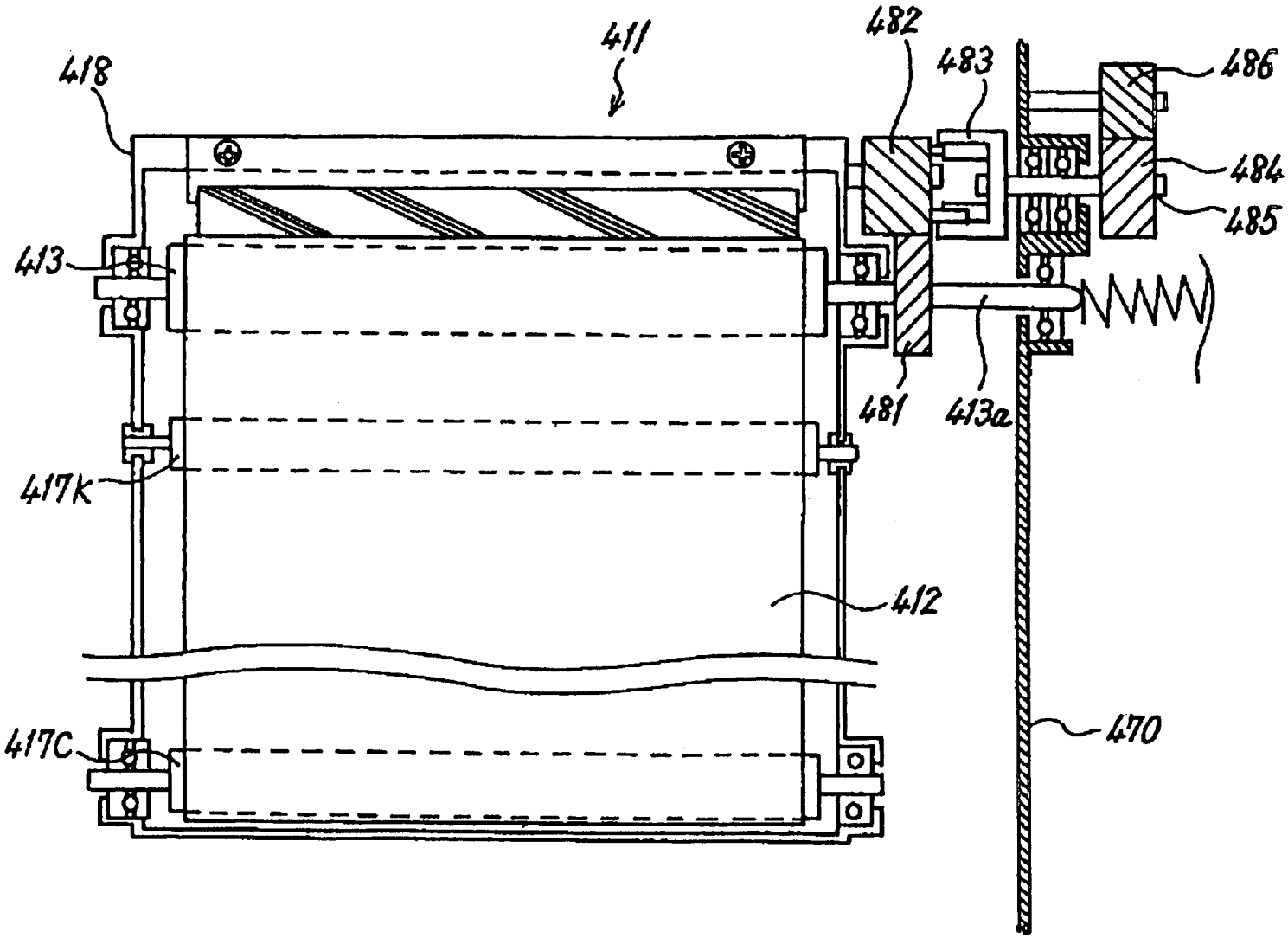
FIG. 14 is a plan view cross-sectional diagram showing the composition of a transfer unit and side plates of the main body of the printer, relating to a third embodiment of the present invention.

FIG. 14 shows the composition of a transfer unit 411 and a printer main body side plate 470 in the present printer. The transfer unit 411 is supported rotatably by means of a supporting body 418, and is detachable from the printer main body. A drive roller 413 which is supported rotatably on the supporting body 418 and which holds a paper conveyance belt 412 in conjunction with two tensioning rollers (not illustrated) is caused to rotate by means of a drive transmission system (described below), thereby causing the paper conveyance belt 412, which forms a moving surface, to move in an endless fashion.

One end of an axle member 413*a* of a drive roller 413 projects significantly from the supporting body 418, and a drive roller gear is fixed to the projecting portion of the axle member 413*a*. Moreover, the front end of the projecting portion is inserted into a positioning bearing provided in the side plate 470 of the printer main body. Thereby, the transfer unit 411 is positioned with respect to the printer main body, and hence the respective photosensitive bodies, by taking the drive roller 413 as a reference.

The drive roller gear 481 meshes with a transfer coupling gear 482 forming a driven side rotational coupling section, which is supported by the supporting body 418. This transfer coupling gear 482 meshes with a transfer rotational coupling section 483 on the drive side, which projects from the side plate 470 of the printer main body. The transfer rotational coupling section 483 and the transfer coupling gear 482 respectively have a similar composition to the rotational coupling section (62) and the coupling gear (52) of the printer relating to the first embodiment. The position of the transfer coupling gear 482Y is corrected as it engages with the transfer rotational coupling section 483Y, thereby forming a mechanism for eliminating any axial misalignment between these elements.

The transfer coupling gear 482Y is fixed to one end of the drive output shaft 485, and the drive output gear 484 is fixed to the other end of the drive output shaft 485. By means of the drive output gear 484 meshing with the uppermost drive gear 486, the rotational drive force of the drive gear 486 is transmitted successively to the drive output gear 484, the transfer rotational coupling section 483, the transfer coupling gear 482, the drive roller gear 481, and the drive roller 4134.

In the present printer having this composition, the position of the transfer coupling gear 484Y is corrected by means of it moving in a direction orthogonal to the axis of rotation, as it engages with the transfer rotational coupling section 483Y, and hence rotational speed variation in the drive roller 413 caused by axial misalignment between the two elements can be eliminated. By this means, it is possible to suppress displacement in the transfer position of the toner image caused by variation in the endless movement speed of the paper conveyance belt 412 due to variation in the rotational speed of the drive roller 413.

In this printer, even if the position of the transfer coupling gear 448Y is corrected as it engages with the transfer rotational coupling section 483Y on the drive side, the gap between the opening section of the transfer coupling gear 484Y and the shaft inserted into same is still maintained. By fixing the transfer coupling gear 484Y after its position has been corrected, whilst maintaining it in an engaged state with respect to the transfer rotational coupling section 483Y, the two elements are kept in a non-contact state. By means of this composition, it is possible to avoid unevenness in the transfer density due to vibrations being generated by friction between the shaft, held in a non-rotatable state, and the inner walls of the opening section of the transfer coupling gear 484Y, which is driven so as to rotate, and these vibrations being transmitted to the paper conveyance belt 412 via the roller axle support plate of the transfer unit 411 and the drive roller 413.

The printer used in the respective embodiments and modifications above is one example of an apparatus to which the present invention can be applied, and it is not limited to such an apparatus. The invention was also described with respect to an example where a two-component developer is used as the developer, but it may of course also be applied to an apparatus using a single-component developer.

In the printer relating the respective embodiments above, an opening section forming a through hole is provided in a coupling gear (52, 352Y, 380Y, 482) forming a rotational coupling section on the driven side, said opening passing through in the direction of the axis of rotation of the gear, and a shaft, which is a body inserted into the opening section, being supported by the apparatus. The position of the coupling gear is corrected by means of it moving in a direction orthogonal to the axis of rotation, due to a gap between the opening section and the shaft inserted into same, as it engages with a drive side rotational coupling section (62, 362Y, 378Y and 483). By means of this composition, it is possible to correct the position of the coupling gear readily, by means of it moving as it engages with the rotational coupling section.

Moreover, in the printer relating to the modification example, the coupling gear 252 forming the rotational coupling section on the driven side is held inside a cylindrical cavity having a larger diameter than the diameter of the outer rotational circumferential surface (the gear diameter) of the coupling gear, and it engages with a drive output shaft section 261 forming is a rotational coupling section on the drive side, which is inserted into the opening section forming a through hole provided in the direction of rotation of the coupling gear. In this composition also, the position of the coupling gear 252 is corrected readily by means of it moving as it engages with the drive output shaft section 261 forming a rotational coupling section.

Furthermore, in the printer relating to a modification example, the coupling gear 252 forming a rotational coupling section on the driven side is provided with a taper on the side of the opening section where the rotational coupling section is inserted, in such a manner that the diameter becomes smaller towards the output side. This provides the following beneficial effects. More specifically, even if there is a large misalignment between the central axes of the opening section of the coupling gear 252 and the drive output shaft 261, before they become engaged, it is still possible to introduce the drive output shaft 261 into the opening section smoothly, by means of the front end of the drive output shaft 261 abutting against the broad input side of the opening section.

Moreover, in the printer relating to the first embodiment, by engaging the developing roller axle 50 provided on one end of the roller gear 51 forming a transmission gear with a positioning bearing forming a position member, the developing roller 42 can be positioned inside the main body of the printer. In this composition, the developing gap between the developing roller 42 and the photosensitive body is set accurately, and hence any variations in developing performance between products caused by assembly errors can be suppressed.

Furthermore, in the printer relating to the present embodiment, the opening section of the coupling gear (52, 352Y, 380Y, 482) whose position is corrected by means of it engaging with the rotational coupling section (62, 362Y, 380Y, 483), and the shaft inserted into the opening section are maintained in a non-contact state, and therefore it is possible to avoid situations where a large load is applied to the rotational drive source, such as the motor, due to the inner walls of the opening section of the coupling gear making contact with the shaft after the position of the gear has been corrected. Furthermore, it is also possible to avoid unevenness in the developing density or in the transfer density, due to vibrations being generated by friction between the coupling gear and the shaft, and these vibrations being transmitted to the developing roller, photosensitive body or belt drive roller.

According to the present invention as described above, a merit is obtained in that it is possible to prevent variation in the rotational speed of a rotating body, such as a developer carrier, caused by misalignment between the central axes of the rotational coupling section on the driven side for causing the rotating body to rotate, and the rotational coupling section on the drive side for transmitting rotational drive force to the aforementioned rotational coupling section.

This beneficial effect is obtained for the following reasons.

According to the present invention as described above, the rotational coupling section on the driven side is fixed by engaging with the rotational coupling section on the drive side, in such a manner that its position can be corrected slightly. In other words, rather then providing an axle in the rotational coupling section on the driven side which is composed in such a manner that it is fixed to the rotational coupling section and rotates in unison with same, as in the prior art, the rotational coupling section on the driven side is disposed in such a manner that it can be moved within a small range with respect to the drive force transmission device and the developing device, before it is engaged with the rotational coupling section on eh drive side. By engaging it with the rotational coupling section on the drive side, the rotational coupling section on the driven side is positioned. By adopting a composition of this kind, it is possible for slight misalignment occurring between the central axes of the driven side and drive side coupling sections, due to problems with the precision of the components or design, or the like, to be absorbed by the driven side rotational coupling section. Therefore, the driven side rotational coupling section always rotates about the centre of rotation of the drive side rotational coupling section. As a result, it is possible to prevent variation in the rotational speed of the rotating body due to axial misalignment. If the rotational drive force received by the rotational coupling section on the driven side is transmitted to a developer carrier, then it is possible to eliminate any variation in the amount of toner conveyed per unit time to the developing position, namely, the position where the developer carrier opposes the latent image carrier, and hence unevenness in the developing density can be prevented.

Various modifications will become possible for those skilled in the art after receiving the teachings of the present disclosure without departing from the scope thereof.

What is claimed is:

1. A drive force transmission device comprising:

a driven side rotational coupling section configured to receive a rotational drive force;

a drive side rotational coupling section coupled with the driven side rotational coupling section such that the rotational drive force is transmitted from the drive side rotational coupling section to the driven side rotational coupling section; and a transmission gear meshing with said driven side rotational coupling section;

wherein a position of said driven side rotational coupling section is corrected in a plane orthogonal to an axis of rotation of the driven side rotational coupling section by disposing a shaft in an opening defined in the driven side rotational coupling section such that the driven side rotational coupling section moves in at least the plane orthogonal to the axis of rotation of the driven side rotational coupling section, a clearance being defined between the shaft and a surface that defines the opening, such that an axis of rotation of the drive side rotational coupling section and the axis of rotation of the driven side rotational coupling section are configured to substantially align with one another when rotating.

2. The drive force transmission device as claimed in claim 1, wherein the opening has a circular shape, the shaft has a circular cross-sectional shape in a direction orthogonal to a direction of insertion of the shaft into the opening, and a difference between diameters of the opening and the shaft is between and/or including 0.5 to 1.0 mm.

3. The drive force transmission device according to claim 1, wherein the driven and drive side rotational coupling sections comprise portions cooperating with one another to transmit the rotational drive force from the drive side rotational coupling section to the driven side rotational coupling section.

4. The drive force transmission device according to claim 3, wherein the drive side rotational coupling section comprises a recess, and the driven side rotational coupling section comprises at least one protrusion disposed within the recess.

5. The drive force transmission device according to claim 4, wherein the drive side rotational coupling section comprises at least one protrusion disposed within the recess, and the protrusion of the drive side rotational coupling section cooperates with the protrusion of the driven side rotational coupling section to transmit the rotational drive force.

6. A developing device for an image forming apparatus comprising:

a developer carrier configured to convey a developer to a latent image carrier; and a drive force transmission device configured to transmit a rotational drive force to said developer carrier, said drive force transmission device comprising:

a driven side rotational coupling section configured to receive the rotational drive force;

a drive side rotational coupling section coupled with the driven side rotational coupling section such that the rotational drive force is transmitted from the drive side rotational coupling section to the driven side rotational coupling section; and a transmission gear meshing with said driven side rotational coupling section;

wherein a position of said driven side rotational coupling section is corrected in a plane orthogonal to an axis of rotation of the driven side rotational coupling section by disposing a shaft in an opening defined in the driven side rotational coupling section such that the driven side rotational coupling section rotates around the shaft in a non-contact state with respect to the shaft, a clearance being defined between the shaft and a surface that defines the opening, such that an axis of rotation of the drive side rotational coupling section and the axis of rotation of the driven side rotational coupling section are configured to substantially align with one another when rotating.

7. The developing device as claimed in claim 6, wherein at least one groove is provided in a surface of said developer carrier.

8. The developing device according to claim 6, wherein the driven and drive side rotational coupling sections comprise portions cooperating with one another to transmit the rotational drive force from the drive side rotational coupling section to the driven side rotational coupling section.

9. The developing device according to claim 8, wherein the drive side rotational coupling section comprises a recess, and the driven side rotational coupling section comprises at least one protrusion disposed within the recess.

10. The developing device according to claim 9, wherein the drive side rotational coupling section comprises at least one protrusion disposed within the recess, and the protrusion of the drive side rotational coupling section cooperates with the protrusion of the driven side rotational coupling section to transmit the rotational drive force.

11. A processing unit configured to be integrally detachable and attachable with respect to an image forming apparatus, the processing unit comprising:

a latent image carrier configured to carry a latent image and a developing device configured to develop the latent image on said latent image camer supported by a common supporting body; and a drive force transmission device configured to transmit a rotational drive force to the developing device, said drive force transmission device comprising:

a driven side rotational coupling section configured to receive the rotational drive force;

a drive side rotational coupling section coupled with the driven side rotational coupling section such that the rotational drive force is transmitted from the drive side rotational coupling section to the driven side rotational coupling section; and a transmission gear meshing with said driven side rotational coupling section;

wherein a position of said driven side rotational coupling section is corrected in a plane orthogonal to an axis of rotation of the driven side rotational coupling section by disposing a shaft in an opening defined in the driven side rotational coupling section such that the driven side rotational coupling section rotates around the shaft in a non-contact state with respect to the shaft, a clearance being defined between the shaft and a surface that defines the opening, such that an axis of rotation of the drive side rotational coupling section and the axis of rotation of the driven side rotational coupling section are configured to substantially align with one another when rotating.

12. A transfer device configured to be disposed in an image forming apparatus, the transfer device comprising:

a body member having a moving surface; and a drive force transmission device configured to transmit a rotational drive force to the body member, said drive force transmission device comprising:

a driven side rotational coupling section configured to receive the rotational drive force;

a drive side rotational coupling section coupled with the driven side rotational coupling section such that the rotational drive force is transmitted from the drive side rotational coupling section to the driven side rotational coupling section; and a transmission gear meshing with said driven side rotational coupling section;

wherein a position of said driven side rotational coupling section is corrected in a plane orthogonal to an axis of rotation of the driven side rotational coupling section by disposing a shaft in an opening defined in the driven side rotational coupling section such that the driven side rotational coupling section rotates around the shaft in a non-contact state with respect to the shaft, a clearance being defined between the shaft and a surface that defines the opening, such that an axis of rotation of the drive side rotational coupling section and the axis of rotation of the driven side rotational coupling section are configured to substantially align with one another when rotating.

13. An image forming apparatus for forming images comprising:

a processing unit configured to be integrally detachable and attachable with respect to an image forming apparatus, the processing unit comprising a latent image carrier configured to carry a latent image and a developing device configured to develop the latent image on said latent image carrier supported by a common supporting body; and a drive force transmission device configured to transmit a rotational drive force to the developing device, said drive force transmission device comprising:

a driven side rotational coupling section configured to receive the rotational drive force;

a drive side rotational coupling section coupled with the driven side rotational coupling section such that the rotational drive force is transmitted from the drive side rotational coupling section to the driven side rotational coupling section; and a transmission gear meshing with said driven side rotational coupling section;

wherein a position of said driven side rotational coupling section is corrected in a plane orthogonal to an axis of rotation of the driven side rotational coupling section by disposing a shaft in an opening defined in the driven side rotational coupling section such that the driven side rotational coupling section rotates around the shaft in a non-contact state with respect to the shaft, a clearance being defined between the shaft and a surface that defines the opening, such that an axis of rotation of the drive side rotational coupling section and the axis of rotation of the driven side rotational coupling section are configured to substantially align with one another when rotating.

14. An image forming apparatus, comprising:

means for forming an image; and a transfer device configured to transfer the image to one of an intermediate transfer body and a recording medium, said transfer device comprising:

a body member having a moving surface; and a drive force transmission device configured to transmit a rotational drive force to the body member, said drive force transmission device comprising:

a driven side rotational coupling section configured to receive the rotational drive force;

a drive side rotational coupling section coupled with the driven side rotational coupling section such that the rotational drive force is transmitted from the drive side rotational coupling section to the driven side rotational coupling section; and a transmission gear meshing with said driven side rotational coupling section;

wherein a position of said driven side rotational coupling section is corrected in a plane orthogonal to an axis of rotation of the driven side rotational coupling section by disposing a shaft in an opening defined in the driven side rotational coupling section such that the driven side rotational coupling section rotates around the shaft in a non-contact state with respect to the shaft, a clearance being defined between the shaft and a surface that defines the opening, such that an axis of rotation of the drive side rotational coupling section and driven side rotational coupling section are configured to substantially align with one another when rotating.

15. An image forming apparatus comprising:

a latent image carrier configured to carry a latent image;

a developing device configured to develop the latent image on said latent image carrier, the developing device comprising a driven side rotational coupling section configured to receive a rotational drive force; and a drive side rotational coupling section coupled with the driven side rotational coupling section such that the rotational drive force is transmitted from the drive side rotational coupling section to the driven side rotational coupling section;

wherein a position of the driven side rotational coupling section is corrected in a plane orthogonal to an axis of rotation of the driven side rotational coupling section by disposing a shaft in an opening defined in the driven side rotational coupling section such that the driven side rotational coupling section rotates around the shaft in a non-contact state with respect to the shaft, a clearance being defined between the shaft and a surface that defines the opening, such that an axis of rotation of the drive side rotational coupling section and the axis of rotation of the driven side rotational coupling section are configured to substantially align with one another when rotating.

16. The image forming apparatus as claimed in claim 15, further comprising:

a transmission gear meshing with said driven side rotational coupling section.

17. The image forming apparatus as claimed in claim 16, wherein the developing device comprises a developing roller, a central axle of said developing roller engaging with a positioning member on a main body of the image forming apparatus.

18. The image forming apparatus as claimed in claim 17, wherein a distance between a surface of the latent image carrier and the developing roller is 0.4 mm or less.

19. The image forming apparatus as claimed in claim 16, wherein the developing device holds a two-component developer including a toner and magnetic particles, the toner comprising an oil-less polymer toner or a low-melting-point toner, the magnetic particles comprising magnetic core particles coated with a resin coating, a resin component comprising a charge adjusting agent and a thermoplastic resin cross-linked with a melamine resin being used as said resin coating.

20. The image forming apparatus according to claim 15, wherein the driven and drive side rotational coupling sections comprise portions cooperating with one another to transmit the rotational drive force from the drive side rotational coupling section to the driven side rotational coupling section.

21. The image forming apparatus according to claim 20, wherein the drive side rotational coupling section comprises a recess, and the driven side rotational coupling section comprises at least one protrusion disposed within the recess.

22. The image forming apparatus according to claim 21, wherein the drive side rotational coupling section comprises at least one protrusion disposed within the recess, and the protrusion of the drive side rotational coupling section cooperates with the protrusion of the driven side rotational coupling section to transmit the rotational drive force.

* * * * *